US007736236B2

(12) United States Patent
Soltys et al.

(10) Patent No.: US 7,736,236 B2
(45) Date of Patent: Jun. 15, 2010

(54) METHOD, APPARATUS AND ARTICLE FOR EVALUATING CARD GAMES, SUCH AS BLACKJACK

(75) Inventors: Richard Soltys, Mercer Island, WA (US); Richard Huizinga, Mercer Island, WA (US); Robert B. Mouchou, Reno, NV (US)

(73) Assignee: Bally Gaming International, Inc., Las Vegas, NV (US)

( * ) Notice: Subject to any disclaimer, the term of this patent is extended or adjusted under 35 U.S.C. 154(b) by 943 days.

(21) Appl. No.: 10/703,414

(22) Filed: Nov. 7, 2003

(65) Prior Publication Data

US 2005/0101367 A1 May 12, 2005

(51) Int. Cl.
*G06F 19/00* (2006.01)

(52) U.S. Cl. ..... 463/47; 273/149 R; 273/149 P; 463/1; 463/16; 463/20

(58) Field of Classification Search ..... 463/1, 463/9–12, 16, 22, 25, 29, 40, 42, 47; 273/292, 273/149 P, 149 R
See application file for complete search history.

(56) References Cited

U.S. PATENT DOCUMENTS

| | | | | |
|---|---|---|---|---|
| 1,034,402 | A | 7/1912 | Hardy | |
| 1,727,800 | A | 9/1929 | Albert | |
| 1,890,504 | A | 12/1932 | Ferguson, Jr. | |
| 2,663,418 | A | 12/1953 | Grunwald | 206/62 |

(Continued)

FOREIGN PATENT DOCUMENTS

| | | |
|---|---|---|
| DE | 44 39 502 | 9/1995 |

(Continued)

OTHER PUBLICATIONS

Bulaysky, J., "Tracking the Tables," *Casino Journal*, pp. 44-47, May 2004.

(Continued)

*Primary Examiner*—Dmitry Suhol
*Assistant Examiner*—Andrew Kim
(74) *Attorney, Agent, or Firm*—Seed IP Law Group PLLC

(57) ABSTRACT

A system reads an identifier from a hand of cards to identify the cards. For example, the system can read an identifier from a pair of cards forming the initial hand in blackjack, where the one card is face up and the other card is face down. The system determines the value of a hand of cards form the read identifiers. For example, the system can determine a value of an initial hand of two cards in blackjack, while only one card is face up. The system can inform a dealer of the value, or status based on value, of the hand. The system can determine whether cards forming a hand of cards are authentic by validating the cards based on the read identifier. The system can determine if the cards forming the hand of cards are in an expected sequence based on knowledge of the initial sequence of cards in a deck. A decision tree to validate the results of the card game can be created to provide possible solutions or outcomes for each hand, and then, invalid solutions can be eliminated from the decision tree based on known card identities, rules of the game, possible outcomes of other player hands, and other information.

30 Claims, 22 Drawing Sheets

U.S. PATENT DOCUMENTS

| | | | | |
|---|---|---|---|---|
| 2,694,662 | A | 11/1954 | Hunter, Jr. | 154/121 |
| 3,222,071 | A | 12/1965 | Lang | 273/149 |
| 3,377,070 | A | 4/1968 | Nottoli | 273/149 |
| 3,493,728 | A | 2/1970 | Braden, Jr. et al. | |
| 3,561,756 | A | 2/1971 | Barnett | 271/41 |
| 3,667,759 | A | 6/1972 | Barr | 273/152.1 |
| 3,690,670 | A | 9/1972 | Cassady et al. | 273/149 P |
| 3,751,041 | A | 8/1973 | Seifert | 273/149 P |
| 3,752,962 | A | 8/1973 | Greskovics | 235/61.11 |
| 3,766,452 | A | 10/1973 | Burpee et al. | 317/262 R |
| 3,787,660 | A | 1/1974 | Meyers et al. | 235/61.9 R |
| 3,814,436 | A | 6/1974 | Boren | 273/149 P |
| 4,026,309 | A | 5/1977 | Howard | 133/8 R |
| 4,031,376 | A | 6/1977 | Corkin, Jr. | 235/156 |
| 4,108,361 | A | 8/1978 | Krause | 235/375 |
| 4,135,663 | A | 1/1979 | Nojiri et al. | 235/463 |
| 4,244,582 | A | 1/1981 | Raees et al. | 273/293 |
| 4,373,726 | A | 2/1983 | Churchill et al. | 273/138 A |
| 4,377,285 | A | 3/1983 | Kadlic | 273/148 A |
| 4,448,419 | A | 5/1984 | Telnaes | 273/143 R |
| 4,531,187 | A | 7/1985 | Uhland | 364/412 |
| 4,534,562 | A | 8/1985 | Cuff et al. | 273/149 P |
| 4,586,712 | A | 5/1986 | Lorber et al. | 273/149 R |
| 4,636,846 | A | 1/1987 | Villarreal | 358/100 |
| 4,659,082 | A | 4/1987 | Greenberg | 273/149 R |
| 4,662,637 | A | 5/1987 | Pfeiffer | 273/149 P |
| 4,667,959 | A | 5/1987 | Pfeiffer et al. | 273/149 R |
| 4,693,480 | A | 9/1987 | Smith | 273/296 |
| 4,711,452 | A | 12/1987 | Dickinson et al. | 273/143 R |
| 4,725,079 | A | 2/1988 | Koza et al. | 283/73 |
| 4,728,108 | A | 3/1988 | Neuwahl | 273/296 |
| 4,750,743 | A | 6/1988 | Nicoletti | 273/148 A |
| 4,755,941 | A | 7/1988 | Bacchi | 364/412 |
| 4,814,589 | A | 3/1989 | Storch et al. | 235/375 |
| 4,817,528 | A | 4/1989 | Baker | 101/395 |
| 4,822,050 | A | 4/1989 | Normand et al. | 273/149 P |
| 4,832,341 | A | 5/1989 | Muller et al. | 273/139 |
| 4,861,041 | A | 8/1989 | Jones et al. | 273/292 |
| 4,885,700 | A | 12/1989 | Kondziolka et al. | 364/519 |
| 4,951,950 | A | 8/1990 | Normand et al. | 273/149 P |
| 4,995,615 | A | 2/1991 | Cheng | 273/292 |
| 5,007,641 | A | 4/1991 | Seidman | 273/138 A |
| 5,039,102 | A | 8/1991 | Miller | 273/148 R |
| 5,050,881 | A | 9/1991 | Nagao | 273/143 R |
| 5,053,612 | A | 10/1991 | Pielemeier et al. | 235/462 |
| 5,067,713 | A | 11/1991 | Soules et al. | 273/149 P |
| 5,103,081 | A | 4/1992 | Fisher et al. | 235/464 |
| 5,110,134 | A | 5/1992 | Laughlin et al. | 273/293 |
| 5,114,153 | A | 5/1992 | Rosenwinkel et al. | 273/292 |
| 5,121,921 | A | 6/1992 | Friedman et al. | 273/149 P |
| 5,157,602 | A | 10/1992 | Fields et al. | 364/412 |
| 5,179,517 | A | 1/1993 | Sarbin et al. | 364/410 |
| 5,186,464 | A | 2/1993 | Lamle | 273/149 R |
| 5,199,710 | A | 4/1993 | Lamle | 273/149 R |
| 5,224,712 | A | 7/1993 | Laughlin et al. | 273/304 |
| 5,258,837 | A | 11/1993 | Gormley | 358/140 |
| 5,259,907 | A | 11/1993 | Soules et al. | 156/277 |
| 5,283,422 | A | 2/1994 | Storch et al. | 235/375 |
| 5,312,104 | A | 5/1994 | Miller | 273/148 R |
| 5,319,181 | A | 6/1994 | Shellhammer et al. | 235/462 |
| 5,343,028 | A | 8/1994 | Figarella et al. | 235/462 |
| 5,362,053 | A | 11/1994 | Miller | 273/148 R |
| 5,364,104 | A | 11/1994 | Jones et al. | 273/292 |
| 5,374,061 | A | 12/1994 | Albrecht | 273/149 R |
| 5,397,133 | A | 3/1995 | Penzias | 273/439 |
| 5,416,308 | A | 5/1995 | Hood et al. | 235/454 |
| 5,417,431 | A | 5/1995 | Gluck | 273/293 |
| 5,431,399 | A | 7/1995 | Kelley | 273/149 P |
| 5,511,784 | A | 4/1996 | Furry et al. | 273/143 R |
| 5,518,249 | A | 5/1996 | Sines et al. | 273/304 |
| 5,548,110 | A | 8/1996 | Storch et al. | 235/472 |
| 5,586,936 | A | 12/1996 | Bennett et al. | 463/25 |
| 5,605,334 | A | 2/1997 | McCrea, Jr. | 273/309 |
| 5,605,504 | A | 2/1997 | Huang | 463/22 |
| 5,613,680 | A | 3/1997 | Groves et al. | 273/138.2 |
| 5,613,912 | A | 3/1997 | Slater | 463/25 |
| 5,632,483 | A | 5/1997 | Garczynski et al. | 273/148 R |
| 5,651,548 | A | 7/1997 | French et al. | 273/309 |
| 5,654,050 | A | 8/1997 | Whalen-Shaw | 428/35.7 |
| 5,655,961 | A | 8/1997 | Acres et al. | 463/27 |
| 5,669,816 | A | 9/1997 | Garczynski et al. | 463/12 |
| 5,681,039 | A | 10/1997 | Miller | 273/148 R |
| 5,698,839 | A | 12/1997 | Jagielinski et al. | 235/493 |
| 5,704,835 | A | 1/1998 | Dietz, II | 463/20 |
| 5,707,287 | A | 1/1998 | McCrea, Jr. | 463/27 |
| 5,711,525 | A | 1/1998 | Breeding | 273/292 |
| 5,722,893 | A | 3/1998 | Hill et al. | 463/47 |
| 5,735,525 | A | 4/1998 | McCrea, Jr. | 273/309 |
| 5,735,742 | A | 4/1998 | French | 463/25 |
| 5,742,656 | A | 4/1998 | Mikulak et al. | 377/7 |
| 5,755,618 | A | 5/1998 | Mothwurf | 453/17 |
| 5,757,876 | A | 5/1998 | Dam et al. | 377/7 |
| 5,766,074 | A | 6/1998 | Cannon et al. | 463/16 |
| 5,769,458 | A | 6/1998 | Carides et al. | 283/102 |
| 5,770,533 | A | 6/1998 | Franchi | 463/42 |
| 5,772,505 | A | 6/1998 | Garczynski et al. | 463/12 |
| 5,779,545 | A | 7/1998 | Berg et al. | 463/22 |
| 5,779,546 | A | 7/1998 | Meissner et al. | 463/25 |
| 5,780,831 | A | 7/1998 | Seo et al. | 235/462 |
| 5,781,647 | A | 7/1998 | Fishbine et al. | 382/1 |
| 5,785,321 | A | 7/1998 | van Putten et al. | 273/309 |
| 5,788,573 | A | 8/1998 | Baerlocher et al. | 463/16 |
| 5,791,988 | A | 8/1998 | Nomi | 463/11 |
| 5,801,766 | A | 9/1998 | Alden | 348/157 |
| 5,803,808 | A | 9/1998 | Strisower | 463/11 |
| 5,803,809 | A | 9/1998 | Yoseloff | 463/13 |
| 5,809,482 | A | 9/1998 | Strisower | 705/30 |
| 5,830,064 | A | 11/1998 | Bradish et al. | 463/22 |
| 5,831,669 | A | 11/1998 | Adrain | 348/143 |
| 5,842,921 | A | 12/1998 | Mindes et al. | 463/16 |
| 5,863,249 | A | 1/1999 | Inoue | 463/20 |
| 5,871,400 | A | 2/1999 | Yfantis | 463/22 |
| 5,895,048 | A | 4/1999 | Smith, Jr. | 273/293 |
| 5,909,876 | A | 6/1999 | Brown | 273/309 |
| 5,911,626 | A | 6/1999 | McCrea, Jr. | 463/27 |
| 5,919,090 | A | 7/1999 | Mothwurf | 463/25 |
| 5,919,091 | A | 7/1999 | Bell et al. | 463/25 |
| 5,941,769 | A | 8/1999 | Order | 463/12 |
| 5,941,771 | A | 8/1999 | Haste, III | 463/17 |
| 5,945,654 | A | 8/1999 | Huang | 235/449 |
| 5,947,820 | A | 9/1999 | Morro et al. | 463/9 |
| 5,949,050 | A | 9/1999 | Fosbenner et al. | 235/449 |
| 5,954,654 | A | 9/1999 | Eaton et al. | 600/462 |
| 5,957,776 | A | 9/1999 | Hoehne | 463/25 |
| 5,967,893 | A | 10/1999 | Lawrence et al. | 463/10 |
| 5,989,122 | A | 11/1999 | Roblejo | 463/22 |
| 6,004,207 | A | 12/1999 | Wilson, Jr. et al. | 463/20 |
| 6,010,404 | A | 1/2000 | Walker et al. | 463/21 |
| 6,021,949 | A | 2/2000 | Boiron | 235/492 |
| 6,027,115 | A | 2/2000 | Griswold et al. | 273/143 R |
| 6,039,650 | A | 3/2000 | Hill | 463/47 |
| 6,042,150 | A | 3/2000 | Daley | 283/86 |
| 6,062,981 | A | 5/2000 | Luciano, Jr. | 463/26 |
| 6,068,552 | A | 5/2000 | Walker et al. | 463/21 |
| 6,093,103 | A | 7/2000 | McCrea, Jr. | 463/27 |
| 6,113,492 | A | 9/2000 | Walker et al. | 463/16 |
| 6,117,009 | A | 9/2000 | Yoseloff | 463/20 |
| 6,117,012 | A | 9/2000 | McCrea, Jr. | 463/27 |
| 6,126,166 | A | 10/2000 | Lorson et al. | 273/148 R |
| 6,142,876 | A | 11/2000 | Cumbers | 463/25 |
| 6,145,838 | A | 11/2000 | White | 273/295 |
| 6,149,154 | A | 11/2000 | Grauzer et al. | 273/149 R |
| 6,152,822 | A | 11/2000 | Herbert | 463/22 |
| 6,154,131 | A | 11/2000 | Jones, II et al. | 340/540 |

6,159,096 A 12/2000 Yoseloff ..... 463/20
6,162,121 A 12/2000 Morro et al. ..... 463/16
6,165,069 A 12/2000 Sines et al. ..... 463/12
6,166,763 A 12/2000 Rhodes et al. ..... 348/143
6,168,520 B1 1/2001 Baerlocher et al. ..... 463/16
6,186,892 B1 2/2001 Frank et al. ..... 463/19
6,186,895 B1 2/2001 Oliver ..... 463/25
6,193,607 B1 2/2001 Kay ..... 463/22
6,196,547 B1 3/2001 Pascal et al. ..... 273/292
6,217,447 B1 4/2001 Lofink et al. ..... 463/12
6,227,971 B1 5/2001 Weiss ..... 463/20
6,234,898 B1 5/2001 Belamant et al. ..... 463/25
6,250,632 B1 6/2001 Albrecht ..... 273/149 R
6,254,096 B1 7/2001 Grauzer et al. ..... 273/149 R
6,254,484 B1 7/2001 McCrea, Jr. ..... 463/27
6,264,109 B1 7/2001 Chapet et al. ..... 235/492
6,267,248 B1 7/2001 Johnson et al. ..... 209/547
6,267,671 B1 7/2001 Hogan ..... 463/25
6,283,856 B1 9/2001 Mothwurf ..... 463/17
6,293,864 B1 9/2001 Romero ..... 463/12
6,299,534 B1 10/2001 Breeding et al. ..... 463/25
6,299,536 B1 10/2001 Hill ..... 463/47
6,312,334 B1 11/2001 Yoseloff ..... 463/25
6,313,871 B1 11/2001 Schubert ..... 348/143
6,315,664 B1 11/2001 Baerlocher et al. ..... 463/21
6,346,044 B1 2/2002 McCrea, Jr. ..... 463/27
6,357,746 B1 3/2002 Sadowski ..... 273/148 R
6,361,044 B1 3/2002 Block et al. ..... 273/149 R
6,371,482 B1 4/2002 Hall, Jr. ..... 273/138.1
6,394,902 B1 5/2002 Glavich ..... 463/20
6,402,142 B1 6/2002 Warren et al. ..... 273/149 R
6,403,908 B2 6/2002 Stardust et al. ..... 209/587
6,406,369 B1 6/2002 Baerlocher et al. ..... 463/20
6,409,595 B1 6/2002 Uihlein et al. ..... 463/29
6,413,162 B1 7/2002 Baerlocher et al. ..... 463/20
6,425,824 B1 7/2002 Baerlocher et al. ..... 463/16
6,446,864 B1 9/2002 Kim et al. ..... 235/382
6,457,715 B1 10/2002 Friedman ..... 273/274
6,460,848 B1 10/2002 Soltys et al. ..... 273/149 R
6,464,581 B1 10/2002 Yoseloff ..... 463/20
6,464,584 B2 10/2002 Oliver ..... 463/25
6,468,156 B1 10/2002 Hughs-Baird et al. ..... 463/25
6,471,208 B2 10/2002 Yoseloff et al. ..... 273/143 R
6,502,116 B1 12/2002 Kelly et al. ..... 708/250
6,503,147 B1 1/2003 Stockdale et al. ..... 463/29
6,508,709 B1 1/2003 Karmarkar ..... 463/42
6,514,140 B1 2/2003 Storch ..... 463/25
6,517,435 B2 2/2003 Soltys et al. ..... 463/25
6,517,436 B2 2/2003 Soltys et al. ..... 463/29
6,517,437 B1 2/2003 Wells et al. ..... 463/30
6,520,857 B2 2/2003 Soltys et al. ..... 463/29
6,527,271 B2 3/2003 Soltys et al. ..... 273/148 R
6,530,836 B2 3/2003 Soltys et al. ..... 463/29
6,530,837 B2 3/2003 Soltys et al. ..... 463/29
6,533,276 B2 3/2003 Soltys et al. ..... 273/148 R
6,533,662 B2 3/2003 Soltys et al. ..... 463/25
6,533,664 B1 3/2003 Crumby ..... 463/42
6,561,897 B1 5/2003 Bourbour et al. ..... 463/13
6,567,159 B1 5/2003 Corech ..... 356/71
6,568,678 B2 5/2003 Breeding et al. ..... 273/149 R
6,575,834 B1 6/2003 Lindo ..... 463/40
6,579,180 B2 6/2003 Soltys et al. ..... 463/25
6,579,181 B2 6/2003 Soltys et al. ..... 463/25
6,582,301 B2 6/2003 Hill ..... 463/11
6,588,750 B1 7/2003 Grauzer et al. ..... 273/149 R
6,588,751 B1 7/2003 Grauzer et al. ..... 273/149 R
6,595,857 B2 7/2003 Soltys et al. ..... 463/29
6,599,185 B1 7/2003 Kaminkow et al. ..... 463/16
6,620,046 B2 9/2003 Rowe ..... 463/25
6,629,591 B1 10/2003 Griswold et al. ..... 194/205
6,629,889 B2 10/2003 Mothwurf ..... 463/25
6,638,161 B2 10/2003 Soltys et al. ..... 463/12
6,645,077 B2 11/2003 Rowe ..... 463/42
6,651,981 B2 11/2003 Grauzer et al. ..... 273/149 R
6,651,982 B2 11/2003 Grauzer et al. ..... 273/149 R
6,652,379 B2 11/2003 Soltys et al. ..... 463/22
6,655,684 B2 12/2003 Grauzer et al. ..... 273/149 R
6,663,490 B2 12/2003 Soltys et al. ..... 463/25
6,676,127 B2 1/2004 Johnson et al. ..... 273/149 R
6,676,516 B2 1/2004 Baerlocher et al. ..... 463/25
6,685,564 B2 2/2004 Oliver ..... 463/25
6,685,568 B2 2/2004 Soltys et al. ..... 463/47
6,688,979 B2 2/2004 Soltys et al. ..... 463/25
6,698,759 B2 3/2004 Webb et al. ..... 273/292
6,712,693 B1 3/2004 Hettinger ..... 463/20
6,712,696 B2 3/2004 Soltys et al. ..... 463/25
6,726,205 B1 4/2004 Purton ..... 273/148 R
6,728,740 B2 4/2004 Kelly et al. ..... 708/250
6,729,956 B2 5/2004 Wolf et al. ..... 463/25
6,729,961 B1 5/2004 Millerschone ..... 463/30
6,736,250 B2 5/2004 Mattice ..... 194/203
6,745,330 B1 6/2004 Maillot ..... 713/200
6,755,741 B1 6/2004 Rafaeli ..... 463/25
6,758,751 B2 7/2004 Soltys et al. ..... 463/29
6,817,948 B2 11/2004 Pascal et al. ..... 463/42
6,848,994 B1 2/2005 Knust et al. ..... 463/25
6,889,979 B2 5/2005 Blaha et al. ..... 273/149 R
6,896,618 B2 5/2005 Benoy et al. ..... 463/25
6,923,719 B2 8/2005 Wolf ..... 463/16
6,955,599 B2 10/2005 Bourbour et al. ..... 463/13
6,964,612 B2 11/2005 Soltys et al. ..... 463/47
6,991,544 B2 1/2006 Soltys et al. ..... 463/42
7,011,309 B2 3/2006 Soltys et al. ..... 273/149 R
7,029,009 B2 4/2006 Grauzer et al. ..... 273/149 P
7,036,818 B2 5/2006 Grauzer et al. ..... 273/149 R
7,073,791 B2 7/2006 Grauzer et al. ..... 273/149 R
7,137,627 B2 11/2006 Grauzer et al. ..... 273/149 R
7,255,344 B2 8/2007 Grauzer et al. ..... 273/149 R
2002/0063389 A1 5/2002 Breeding et al. ..... 273/292
2002/0084587 A1 7/2002 Bennett et al. ..... 273/309
2002/0086727 A1 7/2002 Soltys et al. ..... 463/22
2002/0147042 A1 10/2002 Vuong et al. ..... 463/40
2002/0155869 A1* 10/2002 Soltys et al. ..... 463/11
2002/0163125 A1 11/2002 Grauzer et al. ..... 273/149 R
2002/0165029 A1 11/2002 Soltys et al. ..... 463/47
2002/0187821 A1 12/2002 Soltys et al. ..... 463/11
2003/0032474 A1 2/2003 Kaminkow ..... 463/25
2003/0036425 A1 2/2003 Kaminkow et al. ..... 463/25
2003/0064774 A1 4/2003 Fujimoto et al. ..... 463/16
2003/0064798 A1 4/2003 Grauzer et al. ..... 463/29
2003/0083126 A1 5/2003 Paulsen ..... 463/25
2003/0173737 A1 9/2003 Soltys et al. ..... 273/149 R
2003/0176209 A1 9/2003 Soltys et al. ..... 463/13
2003/0195037 A1 10/2003 Vuong et al. ..... 463/29
2003/0212597 A1 11/2003 Ollins ..... 705/14
2003/0220136 A1 11/2003 Soltys et al. ..... 463/25
2004/0005920 A1 1/2004 Soltys et al. ..... 463/25
2004/0043820 A1 3/2004 Schlottmann ..... 463/43
2004/0067789 A1 4/2004 Grauzer et al. ..... 463/11
2004/0100026 A1 5/2004 Haggard ..... 273/304
2004/0108255 A1 6/2004 Johnson ..... 209/547
2004/0207156 A1 10/2004 Soltys et al. ..... 273/292
2004/0219982 A1 11/2004 Khoo et al. ..... 463/42
2004/0224777 A1 11/2004 Smith et al. ..... 463/47
2004/0229682 A1 11/2004 Gelinotte ..... 463/25
2005/0012270 A1 1/2005 Schubert et al. ..... 273/149 R
2005/0026680 A1 2/2005 Gururajan ..... 463/25
2005/0026681 A1 2/2005 Grauzer et al. ..... 463/29
2005/0026682 A1 2/2005 Grauzer et al. ..... 463/29
2005/0051955 A1 3/2005 Schubert et al. ..... 273/149 R
2005/0051965 A1 3/2005 Gururajan ..... 273/292
2005/0054408 A1 3/2005 Steil et al. ..... 463/11
2005/0062226 A1 3/2005 Schubert et al. ..... 273/149 R
2005/0062227 A1 3/2005 Grauzer et al. ..... 273/149 R
2005/0073102 A1 4/2005 Yoseloff et al. ..... 273/292
2005/0121852 A1 6/2005 Soltys et al. ..... 273/149 P

| | | | | |
|---|---|---|---|---|
| 2005/0137005 | A1 | 6/2005 | Soltys et al. | 463/13 |
| 2005/0156318 | A1 | 7/2005 | Douglas | 257/761 |
| 2005/0164761 | A1 | 7/2005 | Tain | 463/13 |
| 2005/0258597 | A1 | 11/2005 | Soltys et al. | 273/274 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0001217 | A1 | 1/2006 | Soltys et al. | 273/292 |
| 2006/0019745 | A1 | 1/2006 | Benbrahim | 463/29 |

FOREIGN PATENT DOCUMENTS

| | | | |
|---|---|---|---|
| DE | 197 48 930 | A1 | 5/1998 |
| EP | 0 327 069 | A2 | 8/1989 |
| EP | 0 790 848 | | 8/1997 |
| EP | 1 291 045 | A2 | 3/2003 |
| FR | 2 775 196 | | 8/1999 |
| GB | 2 246 520 | A | 2/1992 |
| GB | 2 370 791 | A | 7/2002 |
| GB | 2 380 143 | A | 4/2003 |
| GB | 2 382 034 | A | 5/2003 |
| WO | WO 96/03188 | | 2/1996 |
| WO | WO 96/36253 | | 11/1996 |
| WO | WO 97/13227 | | 4/1997 |
| WO | WO 99/43403 | | 9/1999 |
| WO | WO 00/22585 | | 4/2000 |
| WO | WO 00/62880 | | 10/2000 |
| WO | WO 02/05914 | A1 | 1/2002 |
| WO | WO 02/051512 | A2 | 7/2002 |
| WO | WO 03/004116 | A1 | 1/2003 |
| WO | WO 03/060846 | A2 | 7/2003 |
| WO | WO 2006/039308 | A2 | 4/2006 |

OTHER PUBLICATIONS

Scarne, J., *Scarne's New Complete Guide to Gambling*, Simon & Schuster, Inc., New York, 1974, p. 358-359.
U.S. Appl. No. 10/885,875, filed Jul. 7, 2004, Soltys et al.
U.S. Appl. No. 10/902,436, filed Jul. 29, 2004, Soltys et al.
U.S. Appl. No. 10/962,166, filed Oct. 18, 2004, Soltys et al.
U.S. Appl. No. 11/030,609, filed Jan. 5, 2005, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/337,375, filed Jan. 23, 2006, Soltys et al.
U.S. Appl. No. 11/408,862, filed Apr. 21, 2006, Soltys et al.
U.S. Appl. No. 11/428,240, filed Jun. 30, 2006, Fleckenstein.
U.S. Appl. No. 11/428,244, filed Jun. 30, 2006, Soltys.
U.S. Appl. No. 11/428,249, filed Jun. 30, 2006, Fleckenstein.
U.S. Appl. No. 11/428,253, filed Jun. 30, 2006, Fleckenstein.
U.S. Appl. No. 11/428,258, filed Jun. 30, 2006, Fleckenstein.
U.S. Appl. No. 11/428,264, filed Jun. 30, 2006, Soltys.
U.S. Appl. No. 11/428,286, filed Jun. 30, 2006, Soltys et al.
U.S. Appl. No. 11/437,590, filed May 19, 2006, Soltys et al.
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,988, filed Jun. 30, 2006, Shayesteh.
U.S. Appl. No. 11/479,991, filed Jun. 29, 2006, Soltys.
U.S. Appl. No. 11/480,273, filed Jun. 30, 2006, Soltys.
U.S. Appl. No. 11/480,274, filed Jun. 30, 2006, Huizinga.
U.S. Appl. No. 11/480,275, filed Jun. 30, 2006, Fleckenstein.
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.
U.S. Appl. No. 60/554,090, filed Mar. 17, 2004, Soltys et al.
U.S. Appl. No. 60/838,280, filed Aug. 17, 2006, Soltys et al.
U.S. Appl. No. 60/847,331, filed Sep. 26, 2006, Shayesteh.
Bulaysky, J., "Tracking the Tables," *Casino Journal*, May 2004, pp. 44-47, accessed Dec. 21, 2005, URL=http://www.ascendgaming.com/cj/vendors_manufacturers_table/Trackin916200411141AM.htm, 5 pages.
Griffin, P., *The Theory of Blackjack*, GBC Press, Las Vegas, Nevada, 1979, 190 pages.
Gros, R., "All You Ever Wanted to Know About Table Games," reprinted from *Global Gaming Business*, Aug. 1, 2003, 2 pages.
Pro, L.V., "Book Review—The Card Counter's Guide to Casino Surveillance," *Blackjack Insider Newsletter*, May 2003, #40, accessed Aug. 25, 2006, URL=http:/bjinsider.com/newsletter_40_surveillance.shtml, 5 pages.
Scarne, J., *Scarne's Encyclopedia of Games*, Harper & Row, New York, 1973, p. 153.
Snyder, A., "The High-Tech Eye," excerpt from *Blackjack Forum*, Spring 1997, accessed Dec. 21, 2005, from Casino Software & Services, LLC, URL=http:/www.casinosoftware.com/bj_forum.html.
Terdiman, D., "Who's Holding the Aces Now?", reprinted from *Wired News*, Aug. 18, 2003, 2 pages.
Ward, K., "BJ Tracking System has Players Down for the Count," *Gaming Today*, Mar. 5, 2002, accessed Dec. 21, 2005, from Casino Software & Services, LLC, URL= http://www.casinosoftware.com/gaming_today.html.
Winkler, C., "Product Spotlight: MindPlay," reprinted from *Gaming and Leisure Technology*, Fall 2003, 2 pages.
Bally TMS, "MP21—Automated Table Tracking/Features," 2 pages, Nov. 2005.
Bally TMS, "MPBacc—Intelligent Table Tracking/Features," 2 pages, Nov. 2005.
Bally TMS, "MPBacc—Specifications/Specifications," 2 pages, Nov. 2005.
Bally TMS, "MPLite—Table Management System/Features," 2 pages, Nov. 2005.
Bravo Gaming Systems, "Casino Table Wager Analysis and Player Tracking System—Table Operations/Unique Features," accessed Apr. 11, 2005, URL=http://www.genesisgaming.com, 4 pages.
Casino Software & Services, LLC., accessed Aug. 25, 2006, URL=http:/casinosoftware.com/home.html, 6 pages.
*Gambling Magazine*, "Gaming Company Takes RFID to the Casino," Dec. 27, 2004, accessed Aug. 25, 2006, URL=http:/www.gamblingmagazine.com/managearticle.asp?C=290&A=13186, 4 pages.
International Guild of Hospitality & Restaurant Managers, "Shuffle Master, Inc. (NasdaqNM:SHFL), " accessed Dec. 30, 2003, URL=http://hospitalityguide.com/Financial/Casinos/Shuffle.htm, 3 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Plaintiffs Declaration of Lawrence Luciano in Opposition to Shuffle Master's Motion for Preliminary Injunction, *Card, LLC* v. *Shuffle Master, Inc*., D. Nev. (No. CV-N-03-0244-ECR-(RAM)), Nov. 24, 2003.
Shuffle Master, Inc., "Shuffle Master Announces New Products; Intelligent Table System to Be Dubuted at G2E," Sep. 10, 2003, 2 pages.
Shuffle Master, Inc., "Shuffle Master Gaming Presents The Ultimate Player Rating System . . . Bloodhound Sniffs Out the Pros and Cons," Dec. 31, 1997, 6 pages.
U.S. Appl. No. 11/558,409, filed Nov. 9, 2006, Soltys.
U.S. Appl. No. 60/887,092, filed Jan. 29, 2007, Shayesteh.
English Translation of German Patent No. DE 197 48 930, publication dated of May 14, 1998, inventor: Markeev.
US 6,599,191, 07/2003, Breeding et al. (withdrawn)

* cited by examiner

800

1600

METHOD, APPARATUS AND ARTICLE FOR EVALUATING CARD GAMES, SUCH AS BLACKJACK

TECHNICAL FIELD

This disclosure is generally related to gaming, and particularly but not exclusively, relates to card games, such as blackjack.

BACKGROUND INFORMATION

Card games are a well-known form of recreation and entertainment. Games are typically played with one or more decks of cards, where each deck typically includes 52 cards. Each deck of cards will typically include four suits of cards, including: hearts, diamonds, clubs, and spades, each suit including fourteen cards having rank: 2-10, Jack, Queen, King and Ace. Card games may, or may not, include wagering based on the game's outcome.

One popular card game is known as blackjack. In blackjack, one or more players each compete against a dealer. The players attempt to collect a hand having a total value equal to, or as close to twenty-one, without going over. The value of the hand is determined by the rank of the card. Thus, cards having rank 2-10 have the value 2-10, respectively. Face cards (i.e., Jack, Queen, King) have the value 10, while Aces can have the value 1 or 10 at the player's discretion. An initial hand of two cards having the value of twenty-one (i.e., an Ace plus a ten or a face card) is referred to as a natural "21", or blackjack, and beats other hands with the value of twenty-one. Suits have no bearing on the game of blackjack.

In blackjack, the dealer will initially deal two cards to each of the players and the dealer. The dealer deals in two passes around the table, starting with players at the dealer's far left (i.e., first base) and extending through players at the dealer's far right (i.e., third base) and finally to the dealer. The players' cards are dealt face up in games where the cards are dealt from a shoe, and face down in hand-held games (i.e., games dealt by hand). The rules of play for the dealer are strictly dictated, leaving no decisions up to the dealer. Therefore, there is not a problem with the dealer, or any of the other players at the table, seeing the cards in a player's hand.

The dealer turns over or is dealt one of the dealer's first two cards face up, such that the value of the card is visible to the players at the table. This card is commonly referred to as the "top" card. The dealer leaves or is dealt the second card face down, such that the value of the card is not visible to the players at the table. The face down card is commonly referred to as the "hole" card. In some variations of blackjack, the dealer will immediately determine the value of the hole card, while in other variations of the game the dealer waits until all players have played their hands before checking the value of the hole card.

The dealer then offers each player in succession, from the dealer's left to right the opportunity to accept additional cards from the deck. Each player's hand is completed before the dealer offers the next player the opportunity to receive additional cards. Accepting cards is commonly referred to as "hitting" or taking a "hit." At each player's turn, the player may accept cards, one at a time, trying to build a hand with a value as close to twenty-one as possible, without going over twenty-one. The player may decline further cards at anytime, which is commonly referred to as "standing." The player must terminate play if the value of the player's hand exceeds twenty-one. A hand with a value exceeding twenty-one is commonly referred to as a "bust" or "busted." If the player busts, or has a natural twenty-one (i.e., blackjack), the dealer must complete the player's hand and place that player's cards into a discard holder. Before receiving a third card after the initial hands are dealt, a player can split the player's initial hand. This is commonly referred to as "splitting." The player uses one of the initial cards to form a new hand, placing a wager for the new hand, and retains the other of the initial cards as a part of the original hand.

After each player in turn has declined to accept further cards, the dealer may accept further cards from the deck, with goal of obtaining a hand having a value as close to twenty-one as possible, without exceeding twenty-one. Casinos have rules based on the value of the dealer's hand that dictate when the dealer must take an additional card from the deck (i.e., hit) and when the player must decline further additional cards (i.e., stand). For example, many casinos require the dealer to stand if the dealer's hand has a value of seventeen or more. Some, casinos permit the dealer to take an additional card if the value of the dealer's hand is a soft seventeen, that is, if the value of the dealer's hand is seventeen by counting an Ace held by the dealer as eleven.

If the dealer busts, players who have not also busted win. If the dealer does not bust, all remaining players and the dealer must display their hands to allow the dealer to compare each of the player's hands to the dealer's hand. Those players having a hand with a higher value than the dealer's hand, and who have not exceed twenty-one win. The winning players are paid based on the size of their wager and the odds. Blackjack includes additional rules such as "doubling down" and "insurance" bets, and other variations that are commonly known by those who play blackjack, and will not be further described in the interest of brevity.

Blackjack is particularly popular in casinos and other gaming establishments. Players wager large sums of money while playing blackjack. Thus, it is important to ensure that those playing the game are not cheating. It is also important to monitor the game in a relatively unobtrusive manner to allow casino customers to feel comfortable in their surroundings.

SUMMARY OF THE INVENTION

In one aspect, a method of evaluating card games is provided. The method includes automatically determining a sequence of a set of playing cards in a deck of playing cards, prior to dealing any of the playing cards from the deck in a card game having a plurality of players. For each player, the method generates a plurality of working solutions representing possible outcomes of that player's hand, based at least in part on the determined sequence of the set of playing cards. For each player, the method reduces the plurality of working solutions to a final solution representing a valid outcome of that player's hand, based at least in part on identities of playing cards that have been discarded during the card game.

BRIEF DESCRIPTION OF THE DRAWINGS

In the drawings, identical reference numbers identify similar elements or acts. The size and relative positions of elements in the drawings are not necessarily drawn to scale. For example, the shapes of various elements are not drawn to scale, and some of these elements are arbitrarily enlarged and positioned to improve drawing legibility. Further, the particular shapes of elements, as drawn are not intended to convey any information regarding the actual shape of the particular elements, and have been solely selected for their ease and recognition in the drawings.

DETAILED DESCRIPTION

In the following description, certain specific details are set forth in order to provide a thorough understanding of various embodiments. However, one skilled in the art will understand that the invention may be practiced without these details. In other instances, well-known structures associated with cameras, optics, computers, computer networks, data structures, databases and networks such as the Internet, have not been described in detail to avoid unnecessarily obscuring the descriptions of the embodiments.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Unless the context requires otherwise, throughout the specification and claims which follow, the word "comprise" and variations thereof, such as "comprises" and "comprising" are to be construed in an open, inclusive sense, that is as "including but not limited to."

As an overview, one embodiment provides a card game evaluation system that can be used to evaluate a card game, such as blackjack. The cards have identifiers thereon that can be read to identify the cards in an initial sequence in a deck, before the cards are dealt to the players. The identity of discarded cards can also be read from the identifiers. In an embodiment, the initial deck sequence, the identity of a dealer's initial hand, and the number of active players are initially determined. Based on this information and based on the rules of the game, the embodiment can create a decision tree having a plurality of possible solutions indicative of how individual player hands may have been played. This creation of the decision tree can be performed without knowing the identity of discarded cards.

Then, the decision tree can be "pruned" or otherwise eliminated of invalid solutions. The pruning and determination of invalid solutions can be based at least in part on the identity of some discarded cards or other known card identities, as well as being based at least in part on the rules of the game, on the possible solutions of other players' hands on which other player hands may depend, and other information. After the decision tree has been pruned, only valid solutions remain, which can be used to validate or otherwise authenticate the results of the round of blackjack.

System Environment

Figure 1:
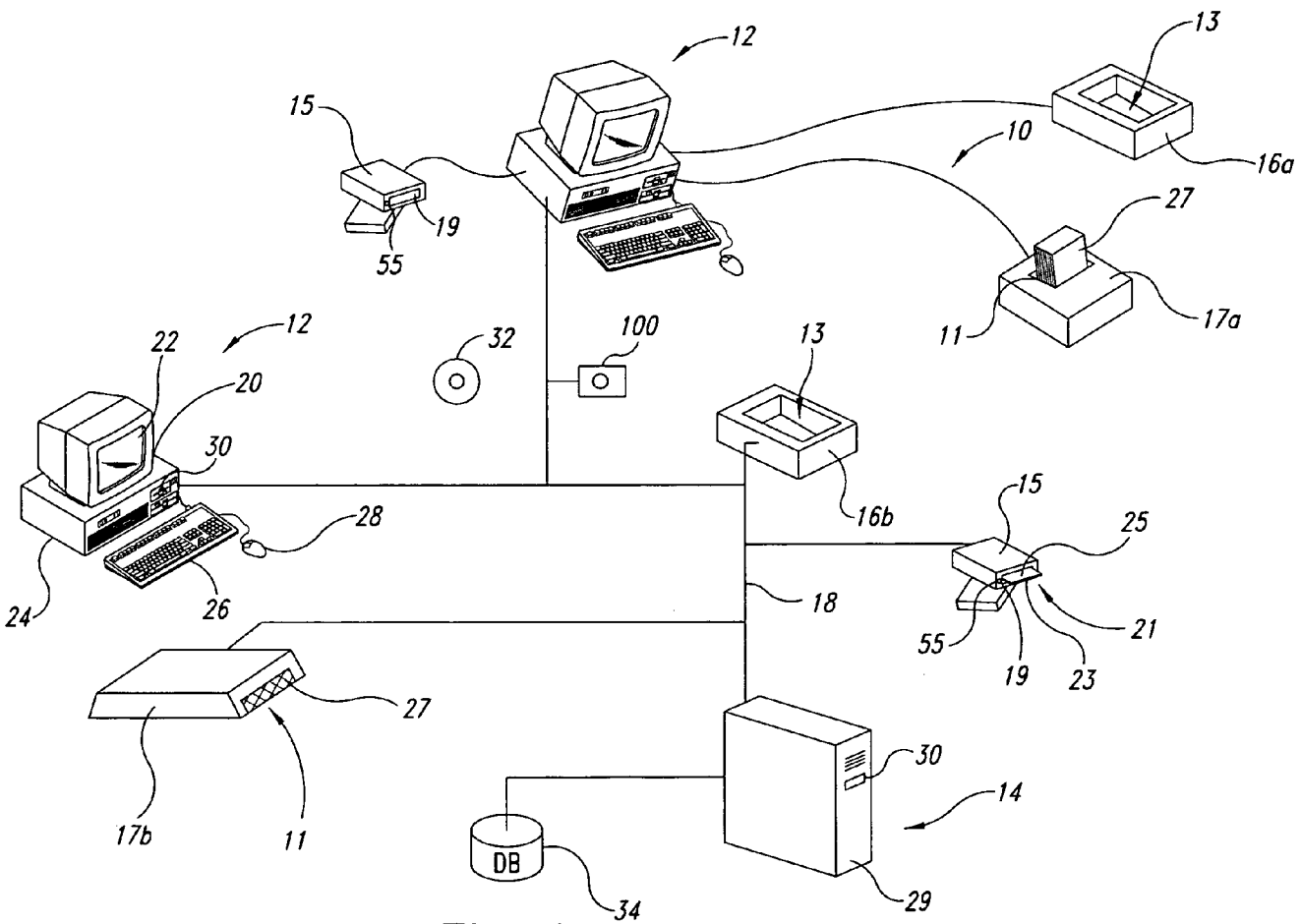
FIG. 1 is a schematic drawing showing an environment in which an embodiment can operate, including a network coupling a number of client computing systems, a server computing system, a card hand reader, and a discard rack having a discard card reader.

FIG. 1 shows a card game evaluation system 10 including a number of client computing systems 12, a server computing system 14, a number of card hand readers 15, a discard rack 16A, 16B, and a number of card deck readers 17A, 17B that communicate over a network 18. The card game evaluation system 10 and method of operation is illustrated in the environment of a blackjack game, although some components and methods are applicable to other types of card games.

The client computing systems 12 each include a display 20, screen 22, cabinet 24, keyboard 26 and mouse 28. The mouse 28 can have one or more user selectable buttons for interacting with a graphical user interface ("GUI") displayed on the screen 22. The cabinet 24 includes a slot 30 for receiving computer-readable media, such as a CD-ROM disk 32. Although the computer-readable media is represented as a CD-ROM disk 32, the card game evaluation system 10 can employ other computer-readable media, including but not limited to, floppy disks, tape, flash memory, system memory, and hard drives. The CD-ROM disk 32 can hold software applications discussed in detail below.

The server computing system 14 includes a cabinet 29 having a slot 30 for receiving computer-readable media, such as a CD-ROM disk similar to the CD-ROM disk 32. The server computing system 14 can optionally include a display, screen, keyboard, and/or mouse as described above. The server computing system 14 also includes a server database 34. The server database 34 is shown as being external to the cabinet 29 for ease of representation in the drawings, although in many embodiments the server database 34 can be located within the cabinet 29.

The card hand reader 15 has a slot 19 sized and dimensioned for receiving a hand of cards, such as the dealer's initial hand 21 that includes the face up top card 23 and the face down hole card 25. An indicator light 55 is placed on the card reader 15 such that it is visible to the dealer. As described in detail in commonly assigned U.S. patent application 60/259,658, filed Jan. 4, 2001, and entitled "Method, Apparatus And Article for Verifying Card Games, Such As Blackjack," the card hand reader 15 is capable of reading an identifier associated with each of the cards 23, 25. The identifier can be encoded, for example, in a machine-readable symbol such as a bar code, or in a magnetic strip, carried by the card 23, 25. The identifier may take the form of a unique identifier, such as a serial number that uniquely identifies each card in the deck of cards, and/or the rank and/or suit of the cards 23, 25. As illustrated, the card hand reader 15 can be directly connected to one of the client computing systems 12, or can be coupled to a client computing system 12 via the network 18.

The card deck reader can take a hand-held form 17A for games dealt by hand, or can take a card shoe form 17B for games dealt from a card shoe. The hand-held card deck reader 17A includes a slot 11 sized and dimensioned to receive one or more decks of playing cards 27. The dealer can insert the deck 27 into the slot 11 prior to beginning a game. The shoe card deck reader 17B contains one or more decks of playing cards 27, and includes a slot 11 sized and dimensioned to allow the dealer to remove one card at a time. The card deck reader 17A, 17B is capable of reading a unique identifier such as a serial number, identifying each card in the deck of cards 27, and/or the rank and suit of the cards in the deck of cards 27. A similar reader is described in commonly assigned patent application Ser. No. 60/130,368 filed Apr. 21, 1999 and Ser. No. 09/474,858 filed Dec. 30, 1999 and entitled "METHOD AND APPARATUS FOR MONITORING CASINO GAMING." Thus, the sequence of the cards in the deck 27 is known to the card game evaluation system 10 at the start of the game. As illustrated, the card deck reader 17A, 17B can be directly connected to one of the client computing systems 12, or can be coupled to a client computing system 12 via the network 18.

The discard rack 16A, 16B includes a slot 13 for receiving cards collected by the dealer after the hands are completed. The discard rack includes suitable electronics and/or optics for identifying the cards placed in the slot 13, for example by reading a unique identifier such as a serial number or the rank and suit of each card, as described in detail below.

One or more optical reader devices 100 may be present in one embodiment to read the presence of bets on the gaming table. For instance, the optical reader devices 100 can have sufficient fields of view to detect the presence of players' betting chips that have been placed in each player's betting circle on a gaming table (not shown). In an embodiment, the optical reader device 100 is also able to determine the amount of a bet, such as for example, by determining the color of the chips placed in the betting circle and the height of a stack of chips. Moreover, it is noted that by determining the presence of bets at each player position, via use of the optical reader devices 100, the card game evaluation system 10 can determine the number of players present in a round of blackjack. Suitable devices can be employed by the optical reader devices 100 to detect the presence of bets, such as image scanners, infrared detectors, cameras, and so forth.

The network 18 can take the form of any conventional network, such as one or more local area networks ("LANs"), wide area networks ("WANs"), and/or extranets, intranets, the Internet, or other wireless or hardwire network.

Low-Level System

Figure 2:
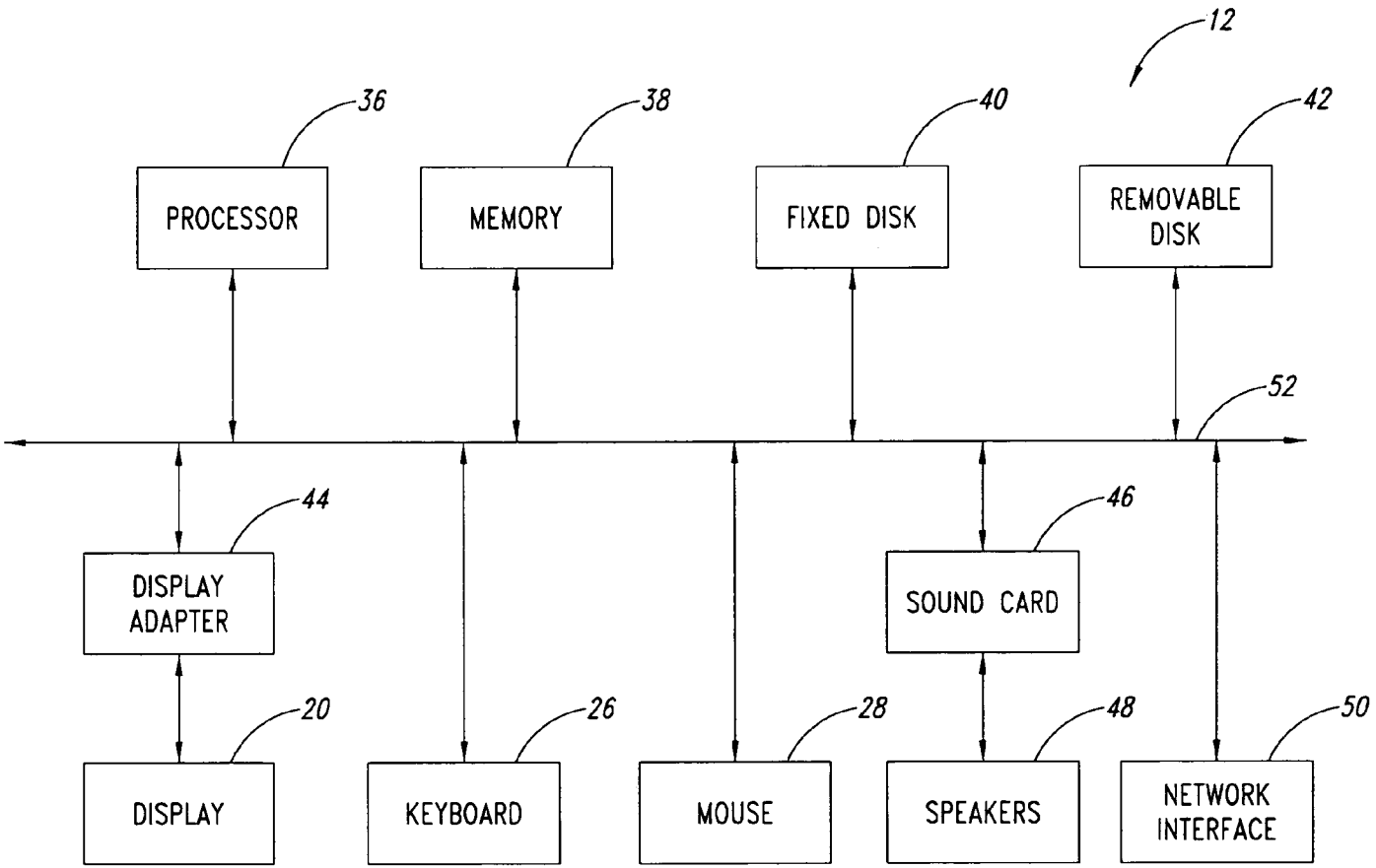
FIG. 2 is a high-level system block diagram showing various hardware elements of the client computing systems of FIG. 1.

FIG. 2 shows a system block diagram of the client computing systems 12 used in executing an illustrated embodiment. As in FIG. 1, the client computing systems 12 each include the display 20, keyboard 26 and mouse 28. Additionally, each of the client computing systems 12 can include subsystems, such as a processor 36, system memory 38, fixed persistent memory 40, media drive 42, display adapter 44, sound card 46, speakers 48, and network interface 50. Arrows 52 represent the system bus architecture of the client computing systems 12.

The client computing systems 12 can take any of a variety of forms, such as a micro- or personal computer, a minicomputer, a workstation, or a palm-top or hand-held computing appliance. The processor 36 can take the form of any suitable microprocessor, for example, a PENTIUM II, PENTIUM III, PENTIUM IV, POWER PC 603 or POWER PC 604 processor. The system memory 38 can take the form of random access memory ("RAM") or other dynamic storage that temporarily stores instructions and data for execution by the processor 36. The fixed persistent memory 40 can take the form of a hard drive or other nonvolatile computer-readable media. The media drive 42 can take the form of a CD-ROM reader, a DVD reader, an optical disk reader, floppy disk reader, or other similar device that reads instructions and/or data from computer-readable media.

While not shown in detail, the server computing system 14 can have a similar structure to the client computing systems 12, as shown in FIG. 2. In practice, the server computing system 14 will typically take the form of a network server, the details of which are commonly understood by those skilled in the art.

The computing systems 12, 14 are illustrative of the numerous computing systems suitable for use with various embodiments. Other suitable configurations of computing systems will be readily apparent to one of ordinary skill in the art having the benefit of this disclosure. Other configurations can include additional subsystems, or fewer subsystems, as is suitable for the particular application. For example, a suitable computing system 12, 14 can include more than one processor 36 (i.e., a multiprocessor system) and/or a cache memory. The arrows 52 are illustrative of any interconnection scheme serving to link the subsystems. Other suitable interconnection schemes will be readily apparent to one skilled in the art having the benefit of this disclosure. For example, a local bus could be utilized to connect the processor 36 to the system memory 38 and the display adapter 44.

Discard Card Reader

Figure 3:
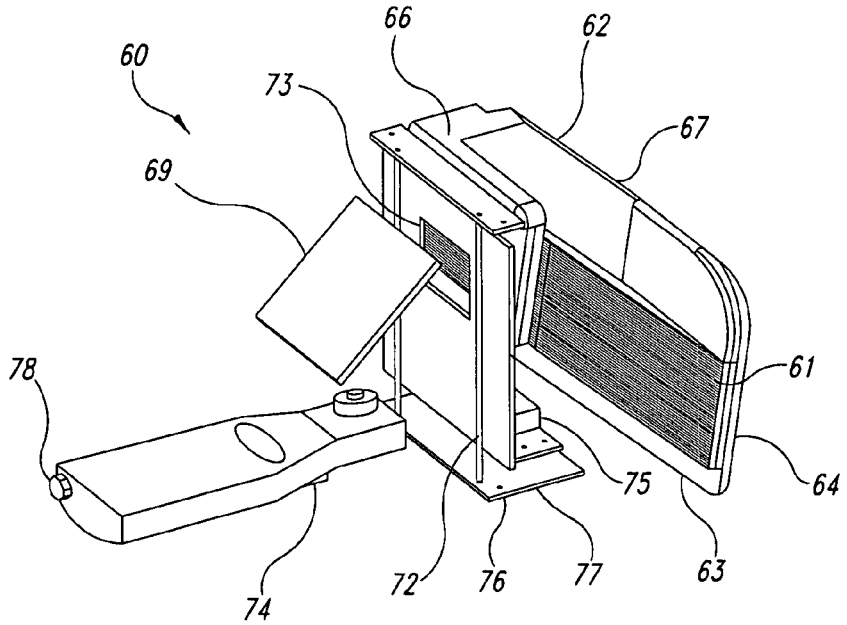
FIG. 3 is perspective view of the discard card reader of FIG. 1, showing an optical lens assembly, imager, reflector, aperture, illumination assembly and connector.
Figure 4:
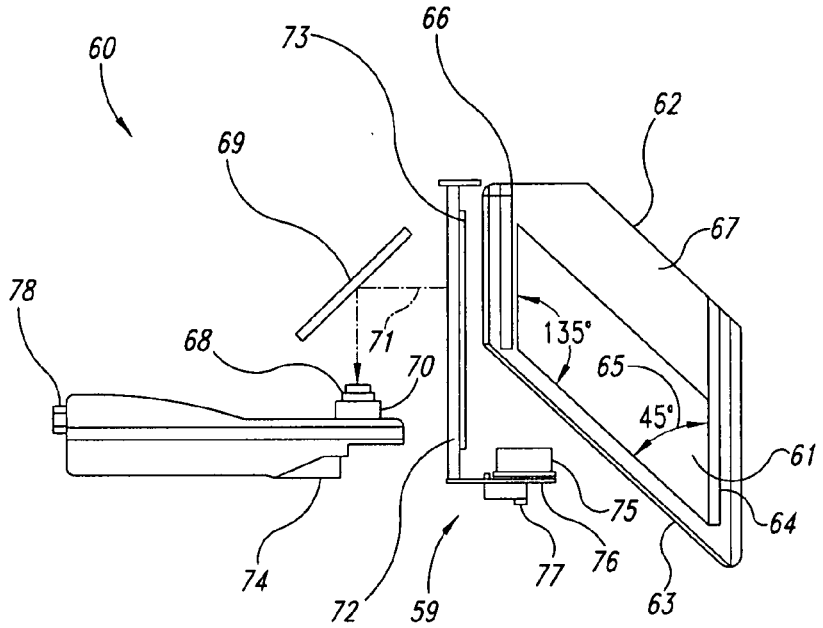
FIG. 4 is side elevation view of the discard card reader of FIG. 3.

FIGS. 3 and 4 show the structure of a discard card reader 60 which can be housed within the discard rack 16. The discard card reader 60 reads an identifier, such as a machine-readable symbol, from the cards 61 constituting one or more completed hands. The machine-readable symbol can take any of a variety of forms, for example, a bar code symbol, or an area or matrix code symbol such as that disclosed in commonly assigned U.S. patent application Ser. No. 60/130,368 and Ser. No. 09/474,858.

Figure 14:
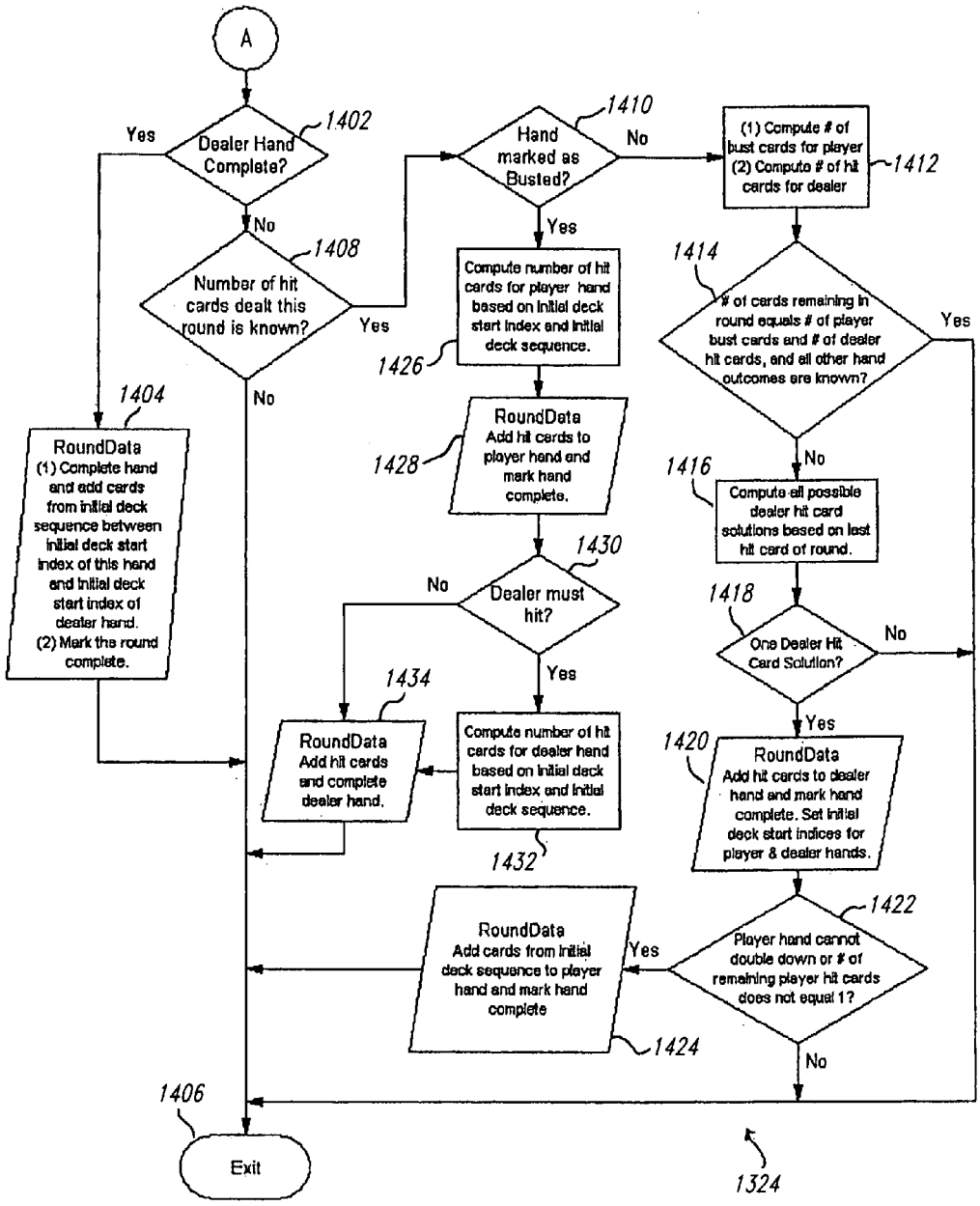
FIG. 14 shows an embodiment of a subroutine of the function of FIG. 13 in more detail.

The machine-readable symbol can be printed on an end 54 of a face 56 of the cards 21 (shown in FIG. 14). The machine-readable symbol is preferably printed such that it is not visually perceptible to humans. For example, the machine-readable symbol can be printed in an ink that is visible only under a particular wavelength of light, such as ultraviolet. Alternatively, the machine-readable symbol can be incorporated into the design on the face 56 of the card, such that the symbol blends in with the design. In a further alternative, the machine-readable symbol can be printed in a magnetic ink. The identifier is printed on a front face (i.e., face with rank and suit indicia) of the cards 61 in one embodiment.

A card guide 62 holds the cards 61 and ensures that the cards 61 are properly positioned with respect to a set of reading components, such as electronics and optical components, described below. The card guide 62 includes a card support surface 63. The card support surface 63 is sloped with respect to a base of the discard rack 16 (FIG. 1), to hold the cards 61 in the discard rack 16 such that the cards 61 are slightly shifted or staggered with respect to adjacent cards (as shown in FIGS. 3 and 4) when the discard rack 16 is on the horizontal playing surface of the gaming table (not shown). A bottom end wall 64 supports the cards 61 on the sloped card support surface 63, and forms an acute angle 65 therewith. An angle 65 of approximately 45 degrees is suitable. A top end wall 66 is transparent, or has a window formed therein, to expose the ends 54 of the faces 56 of the cards 61 in the card guide 62. Side walls 67 help ensure the cards 61 are properly aligned to form a stack within the card guide 62.

The reading electronics and optics can include an optical lens assembly 68, a reflector 69, and an imager 70 aligned along an optical path illustrated by broken line arrow 71. The optical lens assembly 68 can include one or more optical lenses and filters. For example, a 9.9 FL lens assembly available from Sunex Inc., Carlsbad, Calif., part number DSL900, can serve as a suitable optical lens. Also for example, the optical lens assembly 68 can include a narrow band pass filter that passes light having a wavelength of approximately 450 nanometers, while stopping other light, such as light coming directly from an illumination source 72. A suitable filter is available from Edmond Scientific, of Barrington, N.J., as part number 00151-11859.

The imager 70 includes photo-sensitive elements, such as charged-coupled devices ("CCDs") and suitable electronics for producing a digital representation of a captured image. A CMOS color sensor, such as the CMOS color sensor available from Photobit Corporation, Pasadena, Calif., part number PB300, can serve as a suitable imager 70.

The reflector 69 can be positioned at an angle, such as a 45-degree angle, to the top end wall 66 and the imager 70 to pass an image of the ends 54 of the cards 61 to the imager 70. The discard card reader 60 can include additional optical components, such as reflectors, defractors, splitters, polarizers, filters and lenses, where such would be suitable to the particular application. For example, the discard card reader 60 can include an aperture 73 between the reflector 69 and the top end wall 66, which can improve the field of depth of the imager 70. The optical path 71 is defined by the optical properties and position of the optical components, and thus does not necessarily have to be a straight line. Many of the components can be housed in an arm 74, formed from a pair of molded plastic halves.

The discard card reader 60 includes an illumination system 59 having one or more illumination sources 72 that provide low intensity illumination for the cards 61. The illumination sources 72 can take the form of one or more lamps. The illumination sources 72 produce light suitable to the particular embodiment. For example, the discard card reader 60 can employ illumination sources 72 that produce predominately UV light where the machine-readable symbols are only visible under UV illumination. Suitable lamps can include ultraviolet ("UV") lamps available from JKL Components Corporation of Pacoima, California, as part number BF350-UV1, having a diameter of 3 millimeters and a length of 50 millimeters. The illumination sources 72 are located proximate the top end wall 66 of the card guide 62. The illumination sources 72 receive power from a high voltage power inverter 75 via a printed circuit board 76 that receives power from a 5V power source 77. A suitable high voltage power inverter is available from JKL Components Corporation as part number BXA 501A.

The discard card reader 60 is coupled to the network 18 or host computer 12 by way of a connector 78, such as a FIREWIRE connector or Universal Serial Bus ("USB") connector. For example, a FIREWIRE connector available from Molex Electronics, Ltd. of Canada, part number 52462-0611, can serve as a suitable connector 78. The connector 78 can deliver the digital representation of the captured image to the appropriate client computing system 12 for image processing and card validation.

Figure 5:
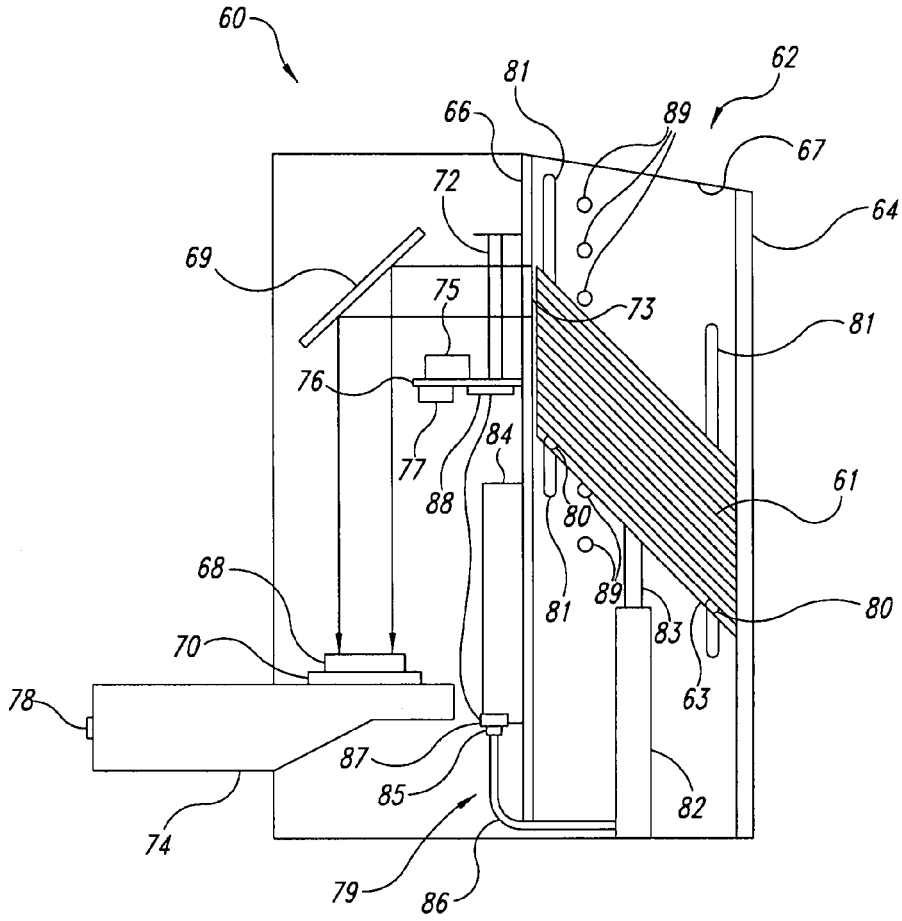
FIG. 5 is side elevation view of an alternative discard card reader, including an actuator for moving the cards relative to an aperture.

FIG. 5 shows another embodiment of the discard card reader 60, that is suitable for reading large numbers of cards (e.g., two to six decks). This embodiment, and those other embodiments and other examples described herein, are substantially similar to previously described embodiments, and common acts and structures are identified by the same reference numbers. Only significant differences in operation and structure are described below.

The embodiment shown in FIGS. 3 and 4 is particularly suited for reading up to two decks of cards, the imager 70 typically having a field of view encompassing up to two decks. The embodiment of FIG. 5 has a similar field of view and moves field of view relative to the cards to incrementally read all of the cards in the discard rack 16.

The discard card reader 60 employs an actuator, such as a jack screw or a hydraulic actuator 79, to incrementally move the cards past the field of view of the imager 70. The actuator 79 moves the card support surface 63 to incrementally pass the cards 61 by the aperture 73. The card support surface 63 is slidably mounted with respect to the bottom end wall 64, top end wall 66 and side walls 67. The card support surface 63 can include a number of tabs 80 which fit in grooves 81 formed in the side walls 67 to guide the card support surface 63 as it advances upward and downward in the card guide 62. The tops and bottoms of the grooves can serve as stops to limit the travel of the card support surface 63. The discard card reader 60 can, of course, employ other guide mechanisms, or may function without such a mechanism. While the illustrated embodiment shows the actuator 79 moving the cards 61, other embodiments can move the reflector 69, imager 70, and/or one or more of these components to sweep the field of view of the imager 70 across all of the cards 61 in the card guide 62.

The hydraulic actuator 79 includes a cylinder 82 and piston 83, which is moved relative to the cylinder 82 by controlling the pressure within the cylinder 82 via a reservoir 84, valve 85 and conduit 86. The discard card reader 60 can of course employ other types of actuators 79. The valve 85 is operated by a solenoid 87 that is controlled via a processor, such as a microprocessor 88 mounted on the circuit board 76.

The discard card reader 60 includes one or more position sensors 89 that detect the position of the card support surface 63, the piston 83, or the cards 61 to determine the height of cards in the card guide 62. This allows the microprocessor 88 to activate the solenoid to adjust the level of the card support surface 63 so that the cards are properly positioned with respect to the aperture 73 to be imaged. The position sensors 89 can take the form of optical switches, mechanical switches, or magnetic switches. For example, an optical switch can take the form of a light source, such as a light emitting diode ("LED"), and a light sensor opposed to the light source across the card guide 62. The insertion of the cards 61 between the light source and light sensor interrupts the reception of light by the light sensor, that acts as the switch. Also for example, a conductor mounted on, or forming a part of, the card support surface 63 can contact one of a number of conductors on the side walls 67 to close a circuit, providing an indication of the position of the card support surface 63, and hence the position of the cards 61. Similarly, a magnet mounted on the card support surface 63 or piston 83 can pass one of a number of magnetic sensors such as a reed switch to provide position information to the microprocessor 88.

The discard card reader 60 incrementally reads groups of cards. The microprocessor 88 can be programmed to advance the cards in set increments, for example ¼ inch increments, past the aperture 73. The microprocessor employs the position of the cards 61 as a trigger for advancing the cards. For example, a signal from a single position sensor 89 positioned above the aperture 73 can indicate that there are cards 61 in the card guide 62 that have not been read. The microprocessor 88 advances the cards by activating the solenoid 87 to open and close the value 85 to the reservoir 84, thereby controlling the flow of a fluid, such as air, into the cylinder 82. The discard card reader 60 can employ other methods of positioning the cards, for example turning a jack screw coupled to the card support surface 63.

Magnetic Discard Card Reader

Figure 6:
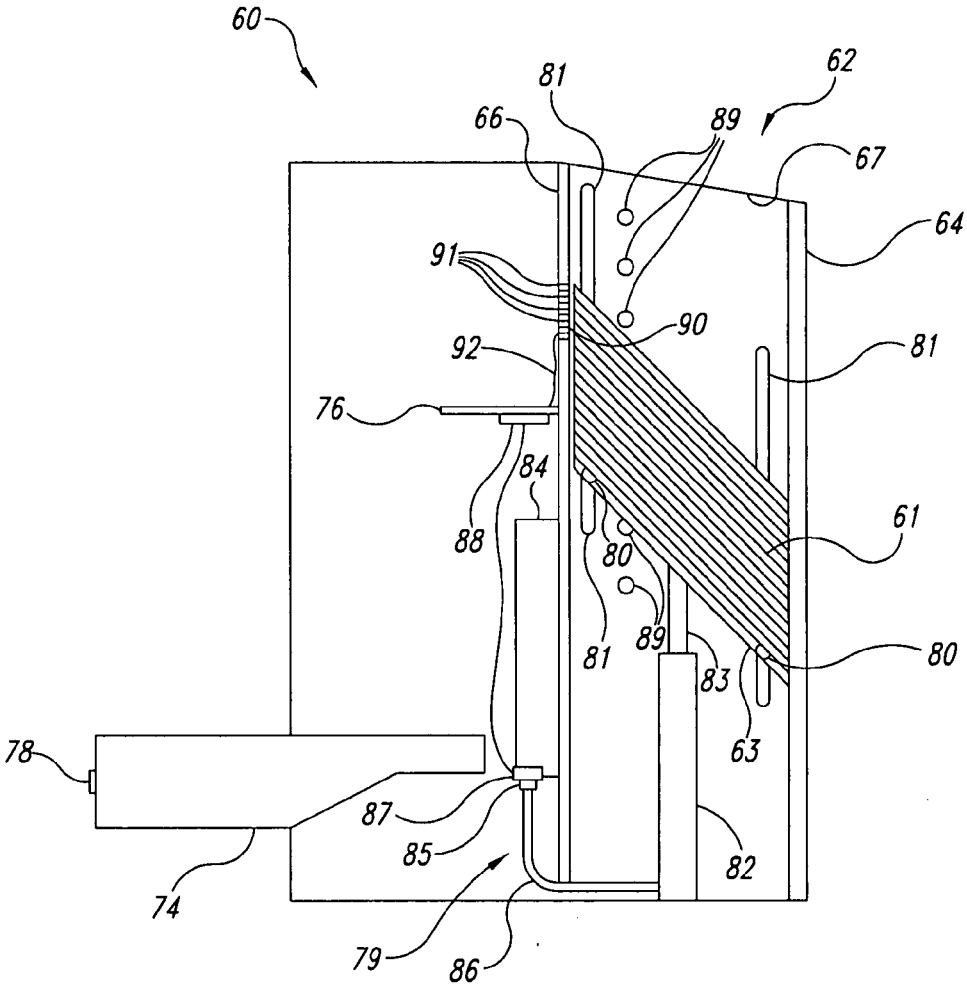
FIG. 6 is side elevation view of an alternative discard card reader, including a magnetic reading head for reading magnetic markings on the cards.

FIG. 6 illustrates a further embodiment, in which the discard card reader 60 can employ a magnetic head assembly 90 for reading cards marked with a magnetic strip. The magnetic head assembly 90 can include one or more magnetic heads 91, positioned in the aperture 73 closely spaced from the ends 54 of the cards 61. The magnetic heads 91 read the information encoded in the magnetic strips as the cards are successively incremented past the magnetic head assembly. Cables 92 couple each of the magnetic heads to the circuit board 76.

Software

Figure 7:
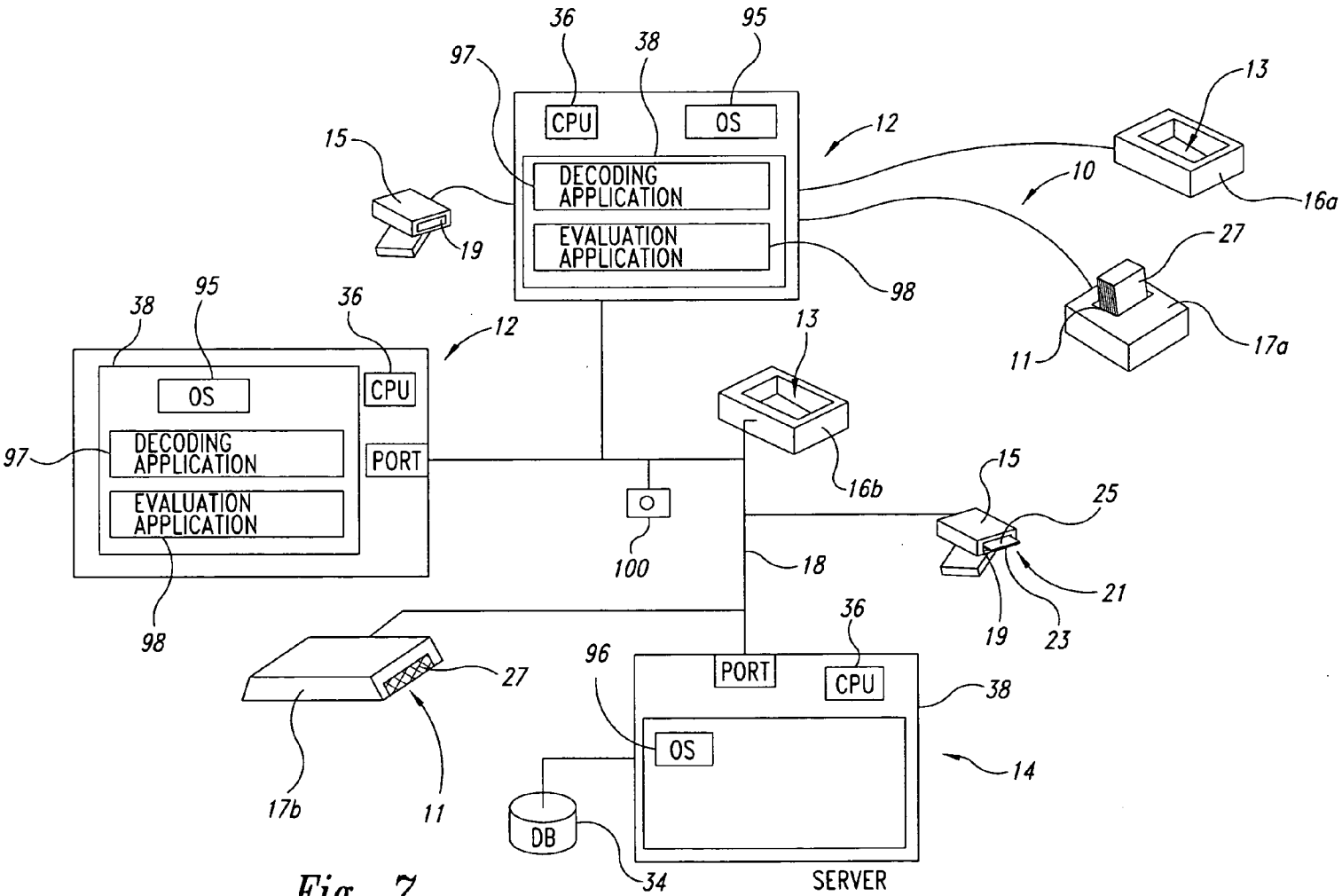
FIG. 7 is a schematic drawing showing the environment of FIG. 1, including a number of software applications loaded into memory on the client and server computing systems.

As shown in FIG. 7, the system memory 38 of the client computing system 12 and server computing system 14 contain instructions and data for execution by the respective processors 36 for implementing the illustrated embodiments. For example, the system memory 38 includes an operating system ("OS") 95, 96 to provide instructions and data for operating the respective computing systems 12, 14. In the case of the client computing systems 12, the OS 95 can take the form of suitable operating systems, such as WINDOWS 95, WINDOWS 98, WINDOWS NT 4.0 and/or WINDOWS 2000, available from Microsoft Corporation of Redmond, Wash., or other operating systems. In the case of the server computing system 14, the OS 96 can take the form of suitable server operating systems, such as WINDOWS NT 4.0 Server, and/or WINDOWS 2000 Server, also available from Microsoft Corporation, or other server operating systems. The OS 95, 96 can include application programming interfaces ("APIs") (not shown) for interfacing with the various subsystems and peripheral components of the computing systems 12, 14, as is conventional in the art. For example, the OS 95, 96 can include APIs for interfacing with a display subsystem 20, 44, keyboard 26, sound subsystem 46, 48 and communications or network subsystem 50.

The system memory 38 of the client and server computing systems 12, 14 can also include additional communications or networking software (not shown) for wired and/or wireless communications on networks, such as local area networks ("LANs"), wide area networks ("WANs"), or the Internet. For example, the client computing system 12 can include a Web client or browser for communicating across the World Wide Web portion of the Internet using standard protocol (e.g., Transportation Control Protocol/Internet Protocol ("TCP/IP"), User Datagram Protocol ("UDP")). A number of Web browsers are commercially available, such as NETSCAPE NAVIGATOR from America Online, and INTERNET EXPLORER available from Microsoft of Redmond, Wash. The server computing system 14 can include a Web server, such as any of the many commercially available Web server applications.

The system memory 38 of the client computing system 12 includes instructions and/or data in the form of a decoding application 97 for resolving the digital image into machine-readable symbols and converting the machine-readable symbols into their respective identifiers and/or ranks and suits. Software for resolving digital images into machine-readable symbols and converting the machine-readable symbols into identifiers is commonly known in the automatic data collection ("ADC") arts. The system can additionally or alternatively include other software for reading and converting other types of identifiers, such a magnetic strips.

The system memory 38 of the client computing system 12 also includes instructions and/or data in the form of an evaluation application 98 for determining the value and/or status of the hand (e.g., blackjack or not). The evaluation application 98 also can authenticate the cards in the hand (i.e., determine that the cards belong to the deck being played), and validate the sequence of the cards comprising the hand with respect to a known sequence of cards for the deck (i.e., no cards missing or inserted).

Overall Method

An embodiment of a technique to evaluate a card game, such as blackjack, using the card evaluation system 10 will now be described. For the sake of simplicity, the rules of blackjack will not be described in detail herein, except when appropriate to further illustrate operation of the embodiment. For further details regarding the game of blackjack and of an embodiment of a technique to evaluate a card game, reference can be made to U.S. patent application Ser. No. 09/790,480, entitled "METHOD, APPARATUS AND ARTICLE FOR EVALUATING CARD GAMES, SUCH AS BLACKJACK," filed Feb. 21, 2001, and assigned to the same assignee as the present application.

Figure 8:
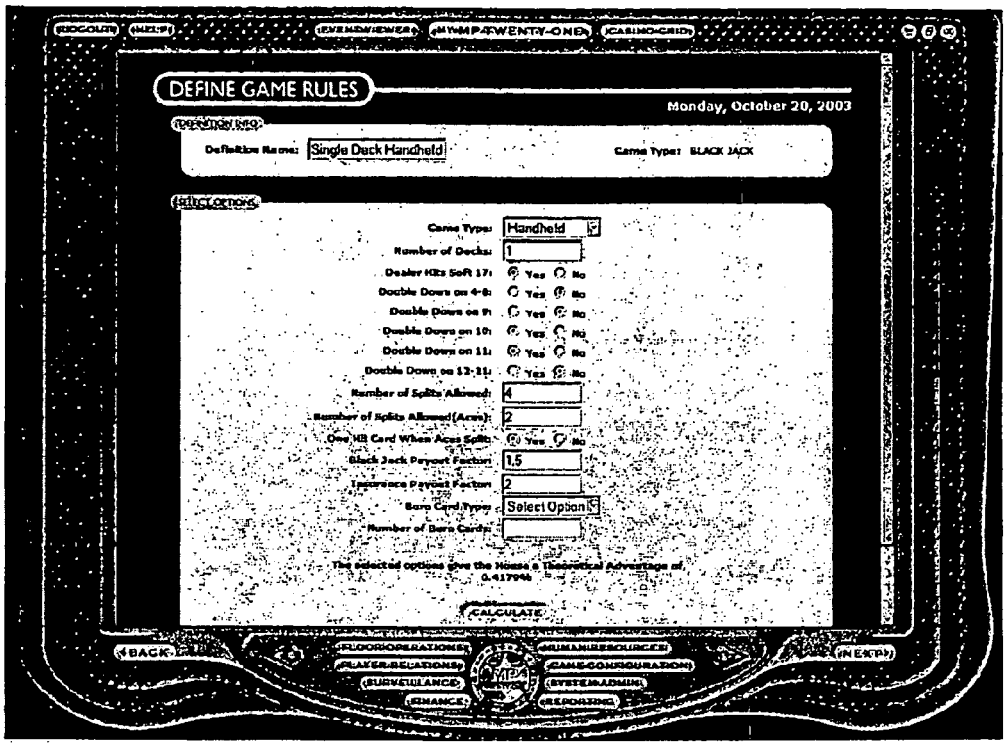
FIG. 8 is a screen shot of an embodiment of a user interface that can be used to set rules for a blackjack table.

Initially, FIG. 8 shows a screen shot of an embodiment of a user interface 800 that can be used to set the rules for a blackjack table. For example, the game type has been set as a "handheld" game (as opposed to a shoe-dealt game), doubling down on initial cards having a total value of 10 or 11 is allowed, the number of splits allowed is specified, and the payout factors are specified. It is appreciated that these are just a few examples of rules that can be set, and that the layout, format, and content of the user interface 800 can vary from one embodiment to another. The user interface 800 can be used to set the game rules for the evaluation application 98 of FIG. 7.

Various flowcharts that represent an embodiment of the technique to evaluate the card game will be illustrated and explained next. At least some elements of these flowcharts can be embodied in software, code, or other machine-readable instruction stored on a machine-readable medium. For example, the evaluation application 98 of FIG. 7 can provide the functionality represented by the flowcharts. It is appreciated that the operations depicted in the flowchart need not necessarily occur in the exact order shown. Moreover, it is appreciated that certain operations or depicted elements can be added, removed, modified, or combined.

Figure 9:
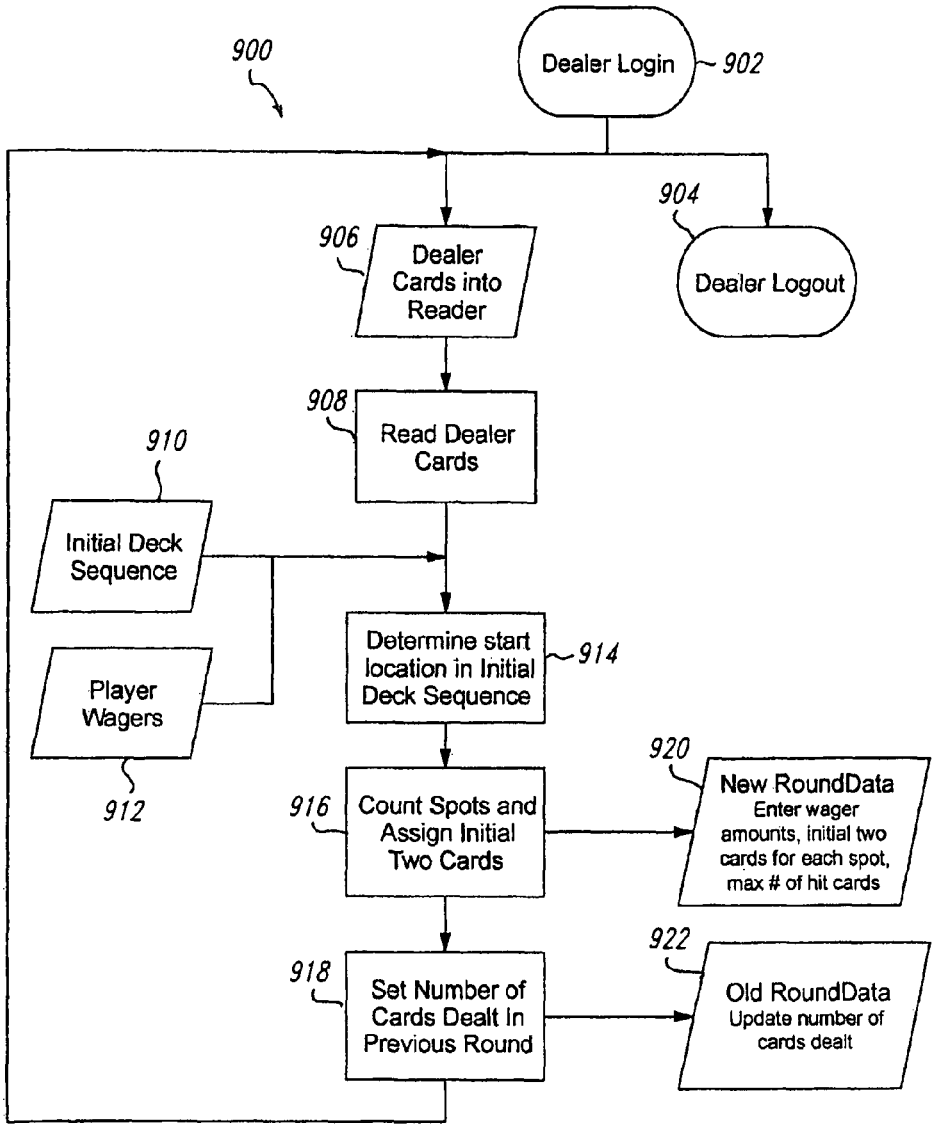
FIG. 9 shows an embodiment of a method to determine a number of players and initial cards dealt to each player during a round of blackjack.

FIG. 9 shows an embodiment of a method 900 to determine the number of players and the initial two cards dealt to each player. The method 900 can run as a first thread on the client computing system 12, and starts when a round has been played. A dealer logs in at a block 902 to begin a round, and logs out at a block 904 when all play has ended.

The dealer inserts his initial two cards into the card hand reader 15 at a block 906. At a block 908, the card hand reader 15 reads the identities of the dealer's cards. As another piece of input information, the card deck reader 17A or 17B reads the initial deck sequence at a block 910 before the cards are dealt. The number and amount of player wagers may also be scanned or otherwise determined at a block 912, such as via use of the optical reader devices 100.

From knowledge of the dealer's initial hand and of the initial deck sequence, the start location of the cards being played in the round in the initial deck sequence can be determined at a block 914. At a block 916, the number of spots or active player positions is determined. Two techniques may be used alternatively or in combination to determine and confirm this information. First, the number of cards dealt between the dealer's initial cards can be counted, using the information from the initial deck sequence. The number of cards between the dealer's initial hand corresponds to the number of players. Second, the number of scanned wagers also corresponds to the number of players.

At a block 920, an object is populated with new information. In one example embodiment, this object is termed "RoundData" and includes the wager amounts, identification of initial two cards in each active player position, and the maximum number of hit cards. The RoundData object is a tracking object whose values can be continuously updated as the round progresses. The identification of the initial hit cards can be in the form of a numerical index, starting at 0 for example, that corresponds to each card in the initial deck sequence. The maximum number of hit cards per player position includes the maximum theoretical number of hit cards that each player can take to bust. This maximum number can be determined through extrapolation by knowing the initial deck sequence and the number of players.

At a block 918, the number of cards dealt in the previous round is set. That is, since there is knowledge of the first card dealt in the current round, the last card dealt in the previous round can also be determined. Knowing the last card dealt in the previous round, plus the initial deck sequence, allows determination of the number of cards dealt in the previous round. An object, such as one termed "Old RoundData" is updated at a block 922 with the number of cards dealt in the previous round.

Figure 10:
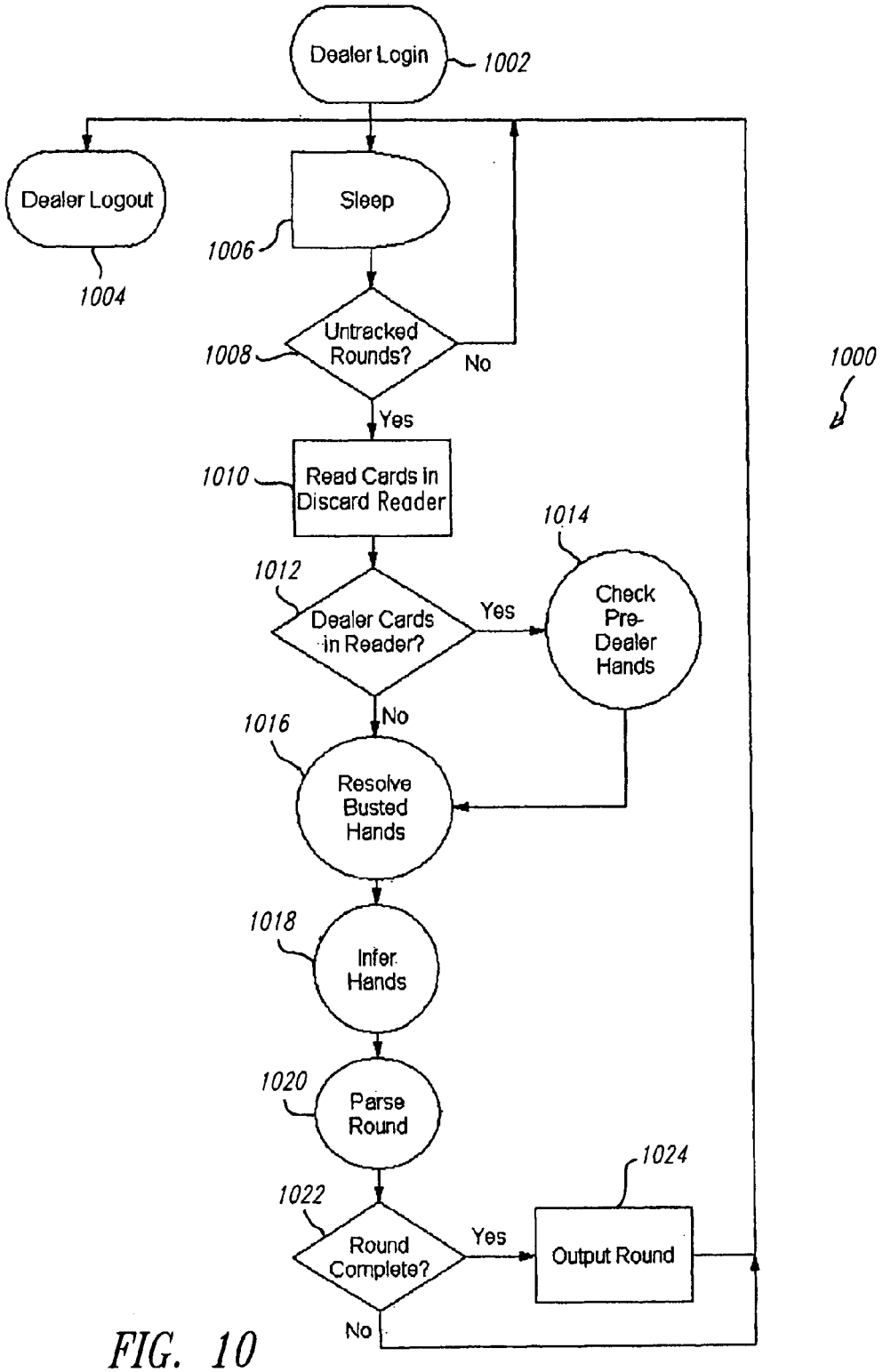
FIG. 10 is a flowchart that provides an overview of a card game evaluation technique.

FIG. 10 is a flowchart 1000 that provides an overview of a card game evaluation technique that can run as a second thread separate from the method 900 of FIG. 9. Dealer login and logout occurs at blocks 1002 and 1004, respectively, to begin and end the thread.

At a block 1006, the card game evaluation system 10 "sleeps" at user configurable intervals. If no untracked rounds are detected at a block 1008 (signifying that every round has been tracked or no round has been played), then the sleeping continues, as there are no rounds to evaluate. If there are untracked rounds at the block 1008, then the card game evaluation system "wakes up" and periodically scans the discard reader 60, for instance, at a block 1010 for discarded cards and reads the identities of the cards therein.

At a block 1012, the card game evaluation system 10 determines if the dealer's cards are in the card hand reader 15. More specifically, certain events may have occurred while the dealer cards are still in the reader. For example, a player may have busted or taken even money. If the dealer's cards are in the card hand reader 15, then the card game evaluation system 10 calls a "Check Pre-Dealer Hands" function at a block 1014. The Check Pre-Dealer Hands function will be described in greater detail later.

If no dealer hands are in the card hand reader 15 at the block 1012, then the card game evaluation system 10 calls a "Resolve Busted Hands" function at a block 1016. Since there are cards in the discard reader and as will be described fully below, the Resolve Busted Hands function attempts to determine which hit cards were taken to bust a hand.

At a block 1018, the card game evaluation system 10 calls an "Infer Hands" function. The Infer Hands function examines the information collected thus far and attempts to determine what has occurred with each hand (e.g., attempts to complete each hand), based on the initial deck sequence and the rules of blackjack and without examining the cards in the discard reader 60.

The card game evaluation system 10 then calls a "Parse Round" function at a block 1020. The Parse Round function builds a decision tree and "prunes" the decision tree to arrive at a valid solution for an outcome of each hand. The Infer Hands and Parse Round functions will be described in greater detail later.

If the round is complete at a block 1022, then the data for the round is output at a block 1024. Otherwise, the technique repeats as described above.

Figure 11:
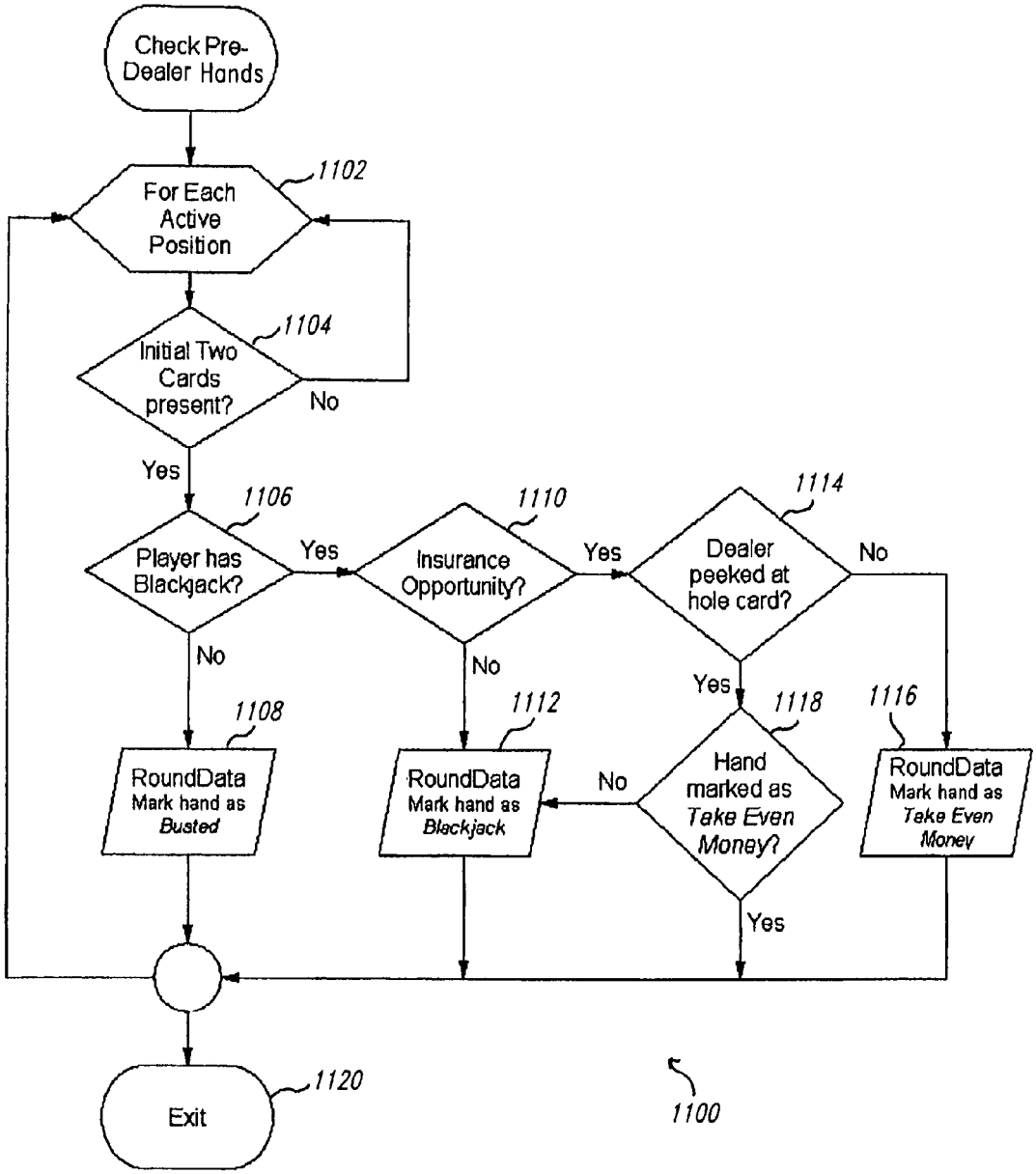
FIG. 11 is a flowchart of one embodiment of a function that can be called by the evaluation technique of FIG. 10 to check pre-dealer hands.

FIG. 11 is a flowchart 1100 of one embodiment of a Check Pre-Dealer Hands function 1100 shown in the block 1014 of FIG. 10. For each active player position at a block 1102, the card game evaluation system 10 checks the discard reader 60 if the initial two cards of the player are present therein. If not present, then the discard reader 60 is checked for the initial two cards for the next active player position. If the discard reader 60 has the two initial cards, then the card game evaluation system 10 checks if the player has a blackjack at a block 1106. If there is no blackjack, then the player has busted, and the RoundData object is updated to mark that particular hand as "busted" at a block 1108. The Check Pre-Dealer Hands function then continues to evaluate remaining positions at block 1102 and exits at a block 1120 when no more positions remain.

If the player has a blackjack at the block 1106, then a block 1110 checks if an insurance opportunity is offered. The RoundData object is updated to mark that particular hand as "blackjack" if the insurance opportunity is not offered at the block 1110, and the Check Pre-Dealer Hands function then continues to evaluate remaining positions at block 1102 and exits at the block 1120 when no more positions remain.

If the insurance opportunity is offered at the block 1110, then the card game evaluation system 10 checks if the dealer has peaked at the hole card at a block 1114. If yes, then the card game evaluation system 10 checks at a block 1118 if the hand is marked as "take even money." If the hand is not marked as such, then the RoundData object is updated at the block 1112 to mark the hand as blackjack. Else, if the hand is marked as "take even money," then the card game evaluation system 10 continues to evaluate remaining positions at block 1102 and exits the Check Pre-Dealer Hands function at the block 1120 when no more positions remain. Also, if the dealer has not peaked at the hole card at the block 1114, then the RoundData object is updated to mark the hand as "take even money" at a block 1116, and the Check Pre-Dealer Hands function then continues to evaluate remaining positions at block 1102 and exits at the block 1120 when no more positions remain.

Figure 12:
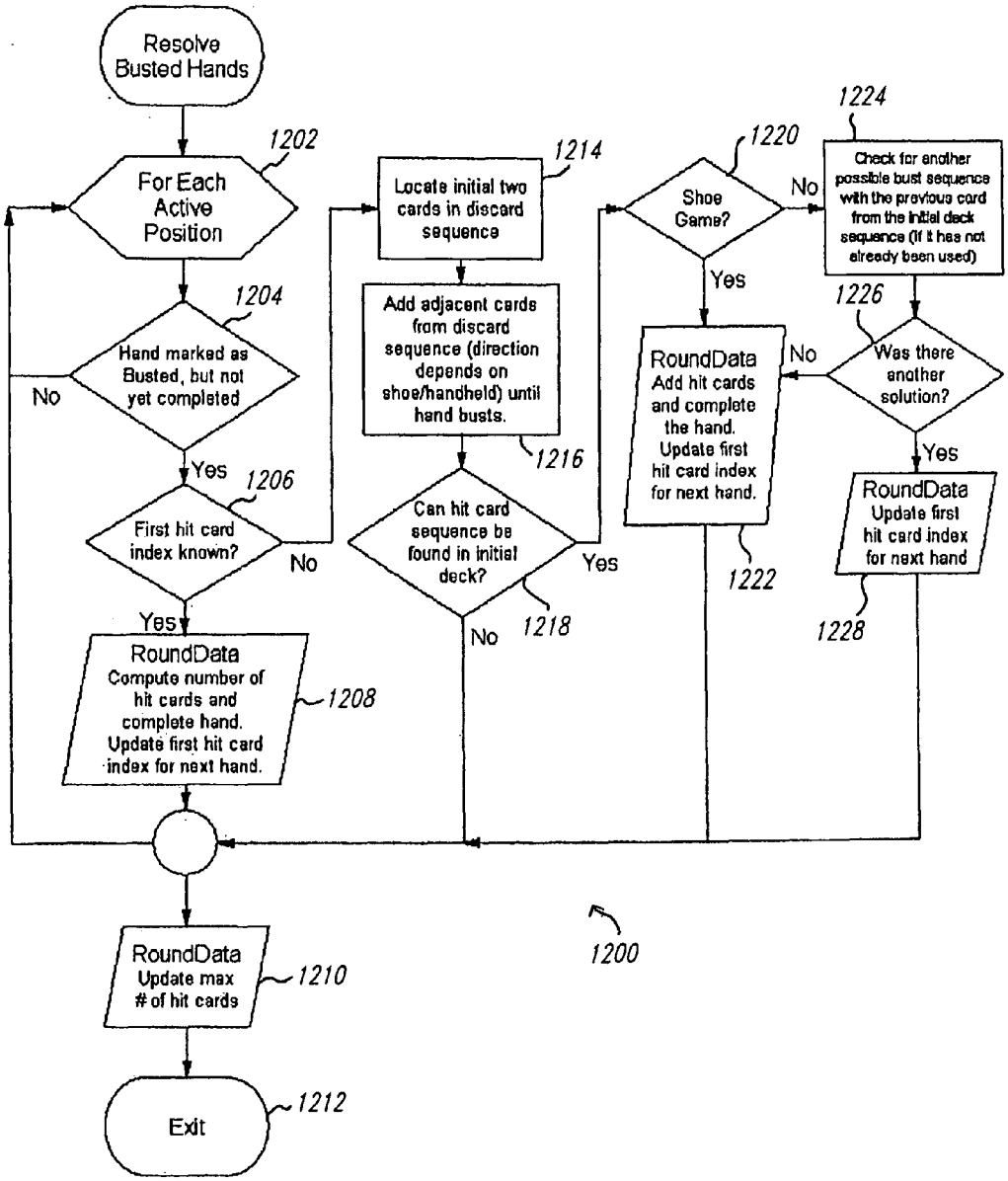
FIG. 12 illustrates one embodiment of a function that can be called by the evaluation technique of FIG. 10 to resolve busted hands.

FIG. 12 illustrates one embodiment of a Resolve Busted Hands function 1200 from the block 1016 of FIG. 10. For each active position at a block 1202, the card game evaluation system 10 checks if a hand marked as busted (from the RoundData object) is not yet completed (i.e., has not yet been determined which cards caused the hand to bust). If the hand has been completed, then the card game evaluation system 10 moves to the next active position at the block 1202.

If the hand is marked as busted and not yet completed, then the card game evaluation system 10 determines at a block 1206 whether the index of the first hit card is known. This first hit card index can be obtained from the RoundData object. If the first hit card index is known, the identity of the first hit card index is thus known from the initial deck sequence. From the first hit card index and the initial deck sequence, the RoundData object can be updated at a block 1208 to compute the number of cards needed to bust the hand. For the next hand (i.e., the next player position), the first hit card index can be identified as the next card from the initial deck sequence, and the RoundData object is updated accordingly. The iteration is continued for remaining positions at a block 1202. The maximum number of hit cards is updated in the RoundData object at a block 1210, and the Resolve Busted Hands function exits at a block 1212 after completing analysis of each active player position.

If the first hit card index is not known at the block 1206, then the card game evaluation system 10 checks the discard reader 60 to attempt to locate the hand's initial two cards in the discard sequence at a block 1214, and then adds the adjacent cards from the discard sequence at a block 1216 until the hand busts. It is noted that the adjacent cards will be either before or after the initial cards in the discard sequence, based on whether the game is dealt from a shoe or handheld.

If the hit card sequence cannot be found in the initial deck sequence at a block 1218, then the card game evaluation system 10 does not have sufficient information to complete the hand. The card game evaluation system 10 moves to the next active position at the block 1202.

If the hit card sequence can be found in the initial deck sequence at the block 1218, then the card game evaluation system 10 determines at a block 1220 whether the game is shoe dealt. If dealt from a shoe, then the RoundData object is updated at a block 1222 to add the hit cards to complete the hand (until a bust). The next card in the initial deck sequence corresponds to the first hit card index of the next hand, and the RoundData object is updated accordingly at the block 1222.

If the game is not a shoe dealt game (i.e., is a handheld game) at the block 1220, the card game evaluation system 10 checks for another possible bust sequence with the previous card from the initial deck sequence (if the previous card has not already been used) at a block 1224. The hit cards are added, the hand is completed, and the first hit card index for the next hand is updated in the RoundData object if there was no other possible solution determined at a block 1226. Else, there is another possible solution and insufficient information to determine what happened in the hand. In this case, the RoundData object is updated with the first hit card index for the next hand at a block 1228.

Figure 13:
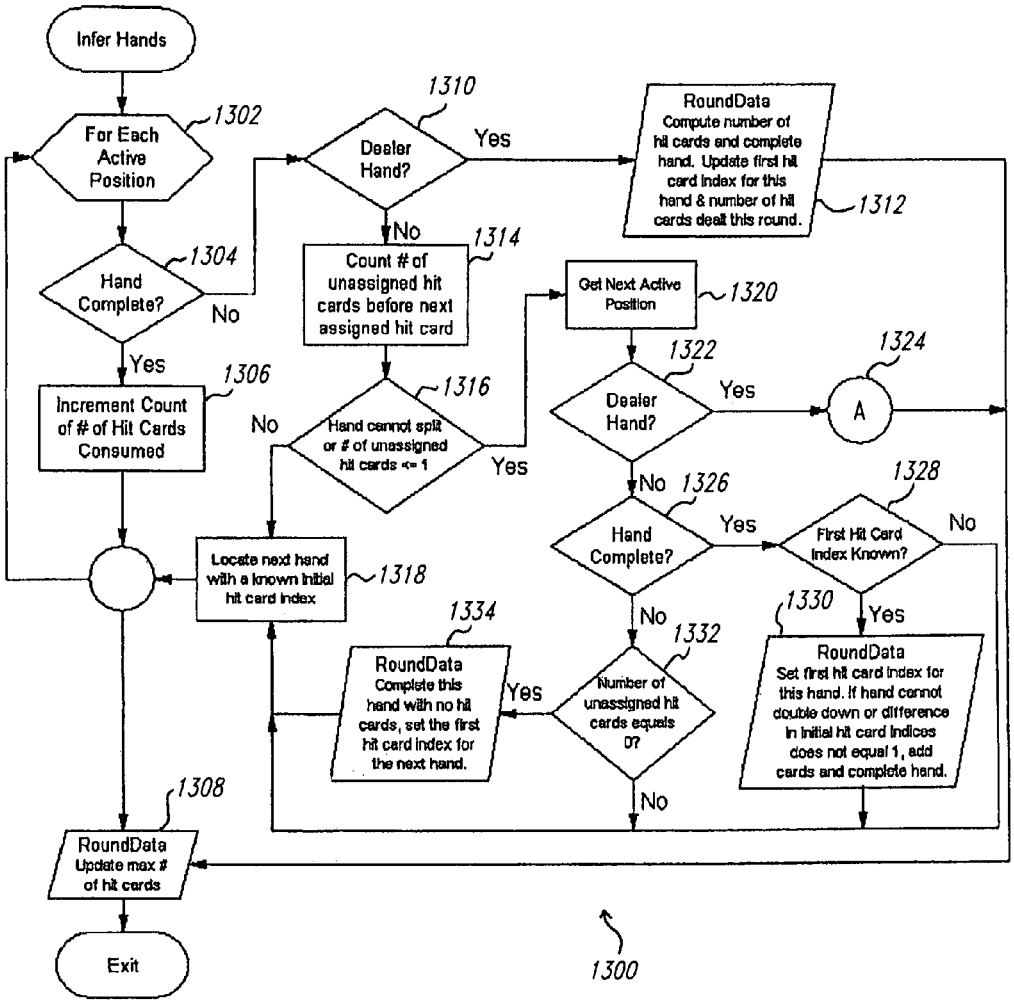
FIG. 13 is a flowchart of one embodiment of a function that can be called by the evaluation technique of FIG. 10 to infer hands.

FIG. 13 is a flowchart 1300 of one embodiment of the Infer Hands function shown in the block 1018 of FIG. 10. Without examining the cards in the discard reader 60, the Infer Hands function attempts to determine if any hands can be automatically completed, using information collected thus far (i.e., the first hit card index for certain hands).

For each active position at a block 1302, the card game evaluation system 10 repeatedly scans until an incomplete hand is detected at a block 1304. If a complete hand is detected at the block 1304, the count of the number of hit cards consumed or dealt is incremented (in the RoundData object) at a block 1306, and the iteration continues for the remaining positions at a block 1302. When no more positions remain, the maximum number of hit cards in the RoundData object is updated at a block 1308.

If an incomplete hand is detected at the block 1304, a block 1310 determines if the hand is a dealer hand. Since the number of hit cards consumed has been tracked at the block 1306 (and therefore the next hit card for the dealer can be determined), since the dealer hand is the last hand in a deck sequence, and since the dealer's play is strictly dictated by the rules of the game, the number of dealer hit cards to reach a hand value of 17 or better can be computed at a block 1312, and the dealer's hand can be completed. Furthermore, the first hit card index for this hand and the number of hit cards dealt in this round can be updated.

If the incomplete hand is determined to not be a dealer hand at the block 1310, the card game evaluation system 10 attempts to find the next hand with a known first hit card index, by counting the number of unassigned hit cards before the next assigned hit card at a block 1314. At a block 1316, the card game evaluation system 10 determines if the incomplete hand cannot split or if the number of unassigned hit cards is less than or equal to 1 (which indicates that the hand cannot split, since 2 hit cards are required for a split). If the hand can split or the number of unassigned hit cards is greater than 1, then there is insufficient information to complete the hand, and the card game evaluation system 10 locates the next hand with a known initial hit card index at a block 1318.

If the conditions are met at the block 1316, however, then the card game evaluation system 10 moves to the next active player position at a block 1320, and determines whether the next active player position corresponds to a dealer hand at a block 1322. If the next active player position does correspond to a dealer hand, then a subroutine A is performed at a block 1324 (explained later).

If the next active position does not correspond to a dealer hand at the block 1322, then a block 1326 determines whether that hand is complete. If complete, a block 1328 determines if the first hit card index is known. If the first hit card index is known, the RoundData object is updated to set the first hit card index for this hand at a block 1330. Additionally if the hand cannot double down or the difference in hit card indices does not equal 1, the cards in the hand are added and the hand is completed. The card game evaluation system 10 then moves to the next hand with a known initial hit card index at the block 1318.

If the first hit card index is not known at the block 1328, then the number of hit cards that went to this hand cannot be determined, and the card game evaluation system 10 moves to the next hand at the block 1318. If the hand is not complete at the block 1326 and if the number of unassigned hit cards equals 0 at a block 1332, then the RoundData object is updated to complete this hand with no hit cards and to set the first hit card index for the next hand. If the number of unassigned hit cards does not equal 0 at the block 1332, then there is insufficient information to complete the hand and the card game evaluation system 10 moves to the next hand at the block 1318.

FIG. 14 shows an embodiment of the subroutine A at the block 1324 of FIG. 13 in more detail. A block 1402 determines if the dealer hand is complete. If complete, then the number of hit cards that went to the dealer is known, as well as which cards were in between the last hand and the dealer hand. At a block 1404 in the RoundData object, the hand prior to the dealer is completed and the card game evaluation system 10 adds the cards from the initial deck sequence between the initial deck start index of this hand and the initial deck start index of the dealer hand. The round is marked as complete, and the subroutine A exits at a block 1406.

If the dealer hand is not complete at the block 1402, a block 1408 determines whether the number of hit cards dealt in this round is known. If the number of hit cards in this round is known, it is possible to determine which cards the dealer and the prior player took, since the dealer has to strictly follow the rules of the game. If the number of hit cards is not known, there is insufficient information for the subroutine A to proceed, and it exits at the block 1406.

If the number of hit cards in this round is known at the block 1408, a block 1410 determines whether the hand prior to the dealer's hand is marked as busted. If not marked as busted, the number of bust cards needed for this player and the number of hit cards needed for the dealer are computed at a block 1412. If the number of cards remaining in the round equals the number of player bust cards and the number of dealer hit cards and if all other hand outcomes are known at a block 1414, then the subroutine A exits at the block 1406 since the outcome cannot be determined (e.g., cannot determine whether the player busted or took additional hit cards).

Otherwise, all possible dealer hit card solutions, based on and knowing the last hit card of the round, are computed at a block 1416. If more than 1 dealer hit card solution exists at a block 1418, then the subroutine A exits at the block 1406. Otherwise, the RoundData object is updated at 1420 to add the hit cards to the dealer hand and to mark the player hand as complete. The initial deck start indices are set for the player and dealer hands.

A block 1422 determines whether the player hand cannot double down or whether the number of remaining player hit cards does not equal 1. If these conditions are not met, the subroutine A exits at the block 1406. If these conditions are met, then the RoundData object is updated at a block 1424 to add cards from the initial deck sequence to the player hand and to mark that player hand as complete.

If the player hand is marked as busted, back at the block 1410, then the card game evaluation system 10 computes the number of hit cards for the player hand based on the initial deck start index and the initial deck sequence at a block 1426. The RoundData object is updated at a block 1428 to add hit cards to the player hand and to mark the player hand as complete.

If the dealer must hit at the block 1430, then the card game evaluation system 10 computes the number of hit cards for the dealer hand based on the initial deck start index and the initial deck sequence at a block 1432. The RoundData object is updated at a block 1434 to add hit cards and to complete the dealer hand.

Figure 15A:
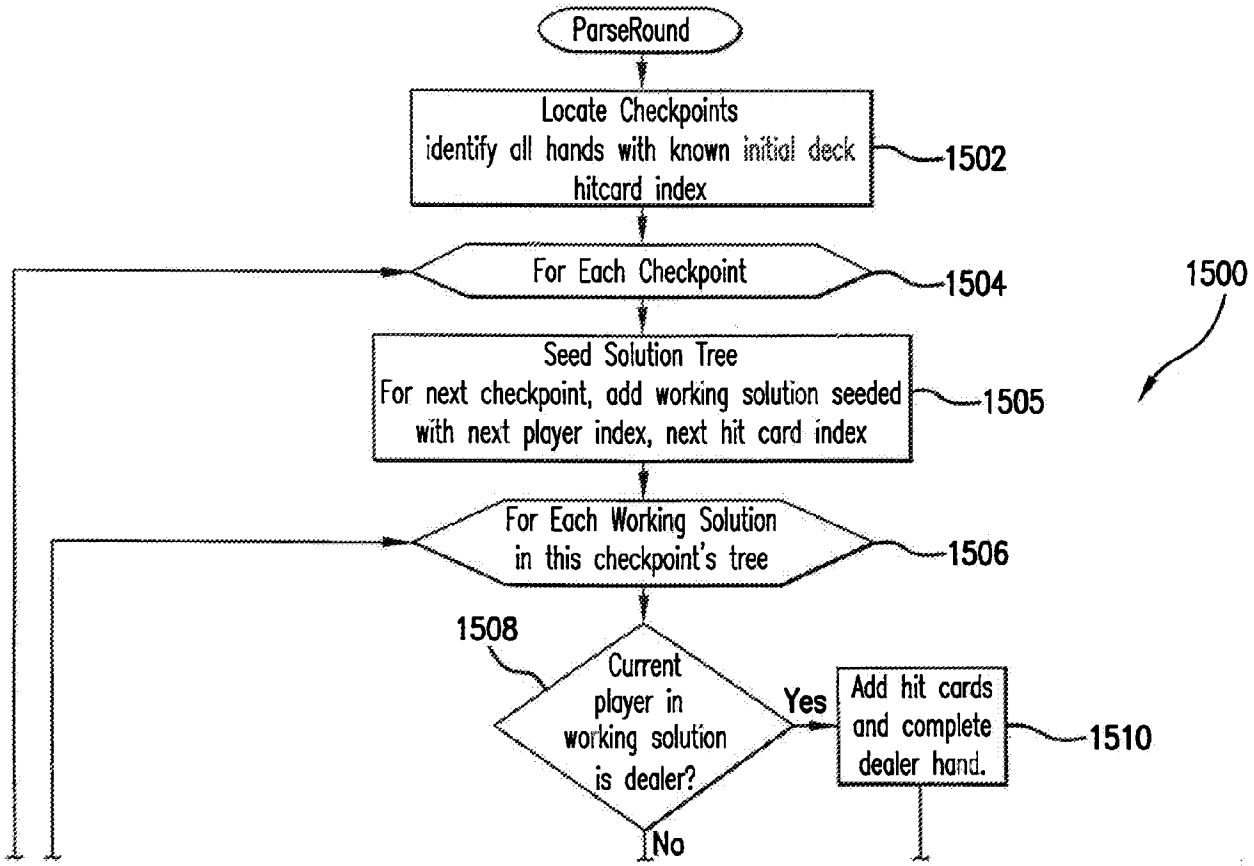
FIGS. 15A-15C show a flowchart of one embodiment of a function that can be called by the evaluation technique of Figure to parse a round, including for building a decision tree and for obtaining valid solutions therefrom.
Figure 15B:
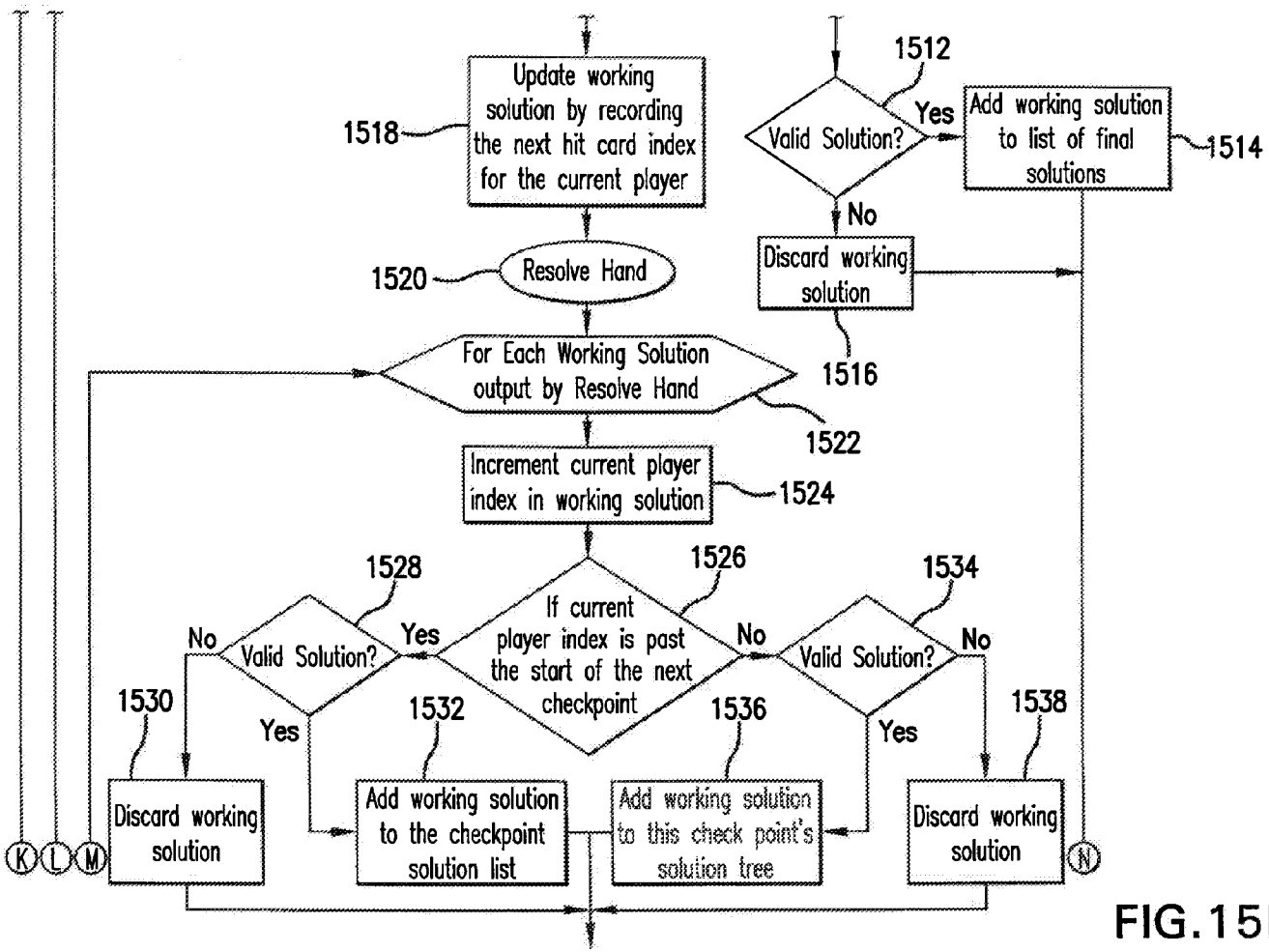
Figure 15C:
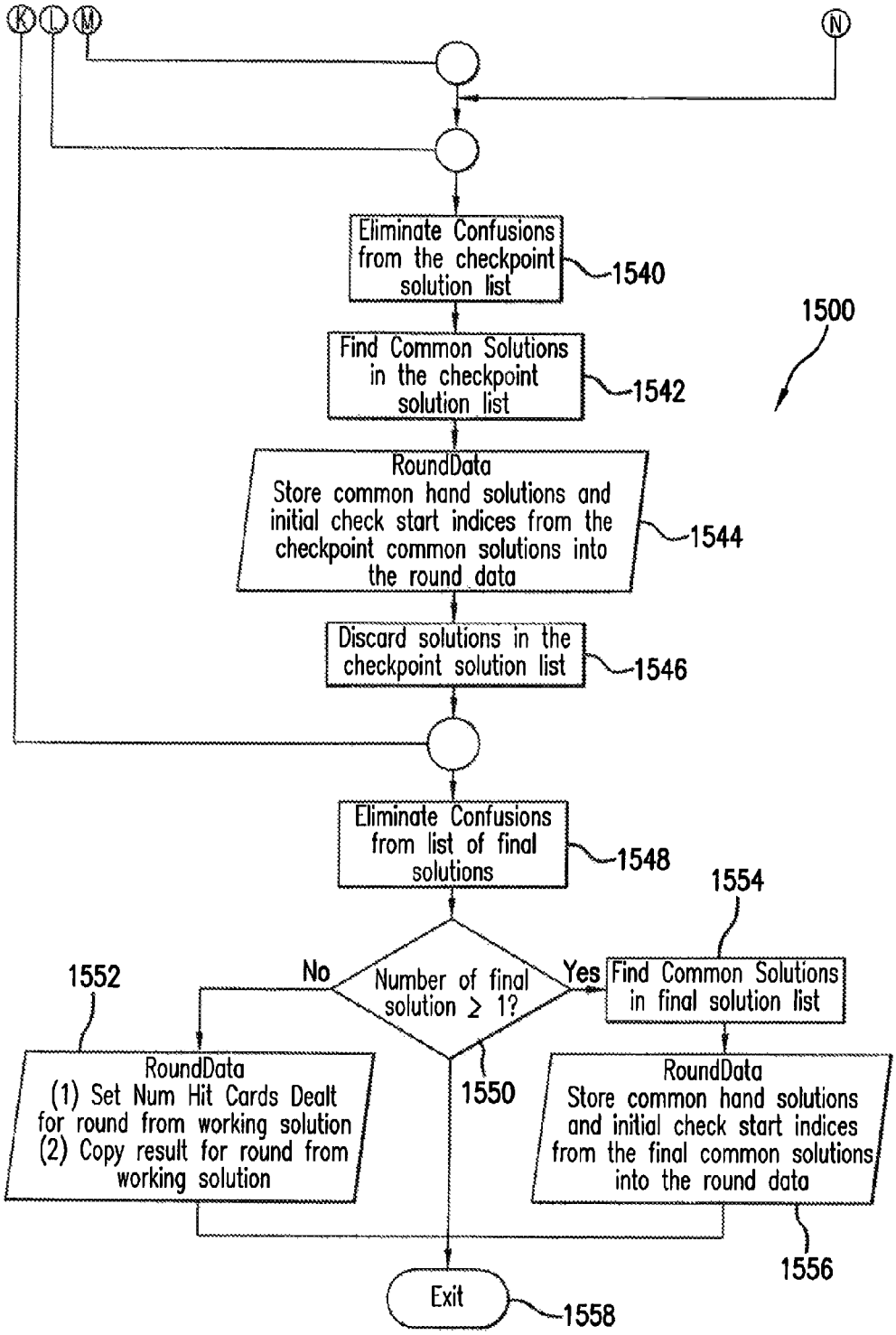

FIGS. 15A-15C show a flowchart 1500 of one embodiment of the Parse Round function shown in the block 1020 of FIG. 10 for building a decision tree and for obtaining valid solutions therefrom. The contents of the discard reader 60 are read in one embodiment to obtain information for building the decision tree.

Checkpoints are located at a block 1502, which involves identifying all hands with known initial hit card indices. An initial hit card index is both a starting point and an ending point, in that if a starting point for a hand is known, then the end point from the prior hand will be known (as will be the total number of hit cards dealt in the prior hand, although the assignments of the hit cards to the other hands are not necessarily known). Therefore according to one embodiment, a particular solution in the decision tree is invalid if it takes more or less cards than necessary to make an initial hit card index the starting point—a valid solution confirms that the initial hit card index is the starting point, as the exact number of hit cards of the prior hands were dealt. The checkpoints can be thought of as non-prunable branches of the tree, which in turn have their own branches made up of working solutions, some of which are invalid and are pruned and some of which are valid and become final solutions.

According to one embodiment, the flowchart 1500 includes a plurality of iterative loops. In a first loop 1504, working solutions are iteratively generated for each checkpoint (branch). In a second loop 1506 nested within the first loop 1504, multiple working solutions (branches) are generated for each checkpoint and checked for validity. An object called "WorkingSolution," for example, is updated at a block 1505 with a working solution for each checkpoint, wherein that working solution is "seeded" with a current player index and a next hit card index (both indexes being contained in the Working Solution object. This procedure creates a new branch in the decision tree, and provides a reference as to where the branch is in the initial deck sequence, which player position is being processed, and operates on the first sub-hand for the player. There is thus initially just one solution.

In the second loop 1506, a block 1508 checks if the current player in the working solution is the dealer. If the current player is the dealer, then the hit cards are added together and the dealer hand is completed at a block 1510. This operation is based in part on knowledge that the dealer needs to follow the rules of the game, such as whether the dealer has to stand or hold at 17, and therefore the next hit card index is known.

At a block 1512, the card game evaluation system 10 determines if the current working solution is a valid solution. An embodiment of a technique to determine validity is illustrated in a flowchart 1900 in FIG. 19. At a block 1902, the card game evaluation system 10 determines whether the current player is the dealer and whether the number of hit cards dealt for the round is known. Since the current player has been determined to be the dealer at the block 1508 and the number of hit cards dealt for the round is known, the number of hit cards dealt to all hands in this solution is counted at a block 1914. If the number of counted hit cards for all hands equals the number of known hit cards for the round at a block 1916, then the solution is determined to be valid at a block 1910. Else, the solution is invalid at a block 1912, and the flowchart 1900 exits at a block 1914. Blocks 1904 to 1912 of the flowchart 1900 will be described later with respect to evaluating the validity of solutions for non-dealer hands.

Returning to the flowchart 1500, if the solution was determined to be valid by the flowchart 1900, then the solution (a working solution) is added to a list of final solutions at a block 1514. If invalid, the working solution is discarded at a block 1516, thereby pruning that branch from the decision tree. The flowchart proceeds to analyze the next working solution in the loop at the block 1506.

Back at the block 1508, if the current player in the working solution is not the dealer, then the working solution is updated by recording the next hit card index for the current player at a block 1518. The current player's hand is then resolved at a block 1520.

Figure 16A:
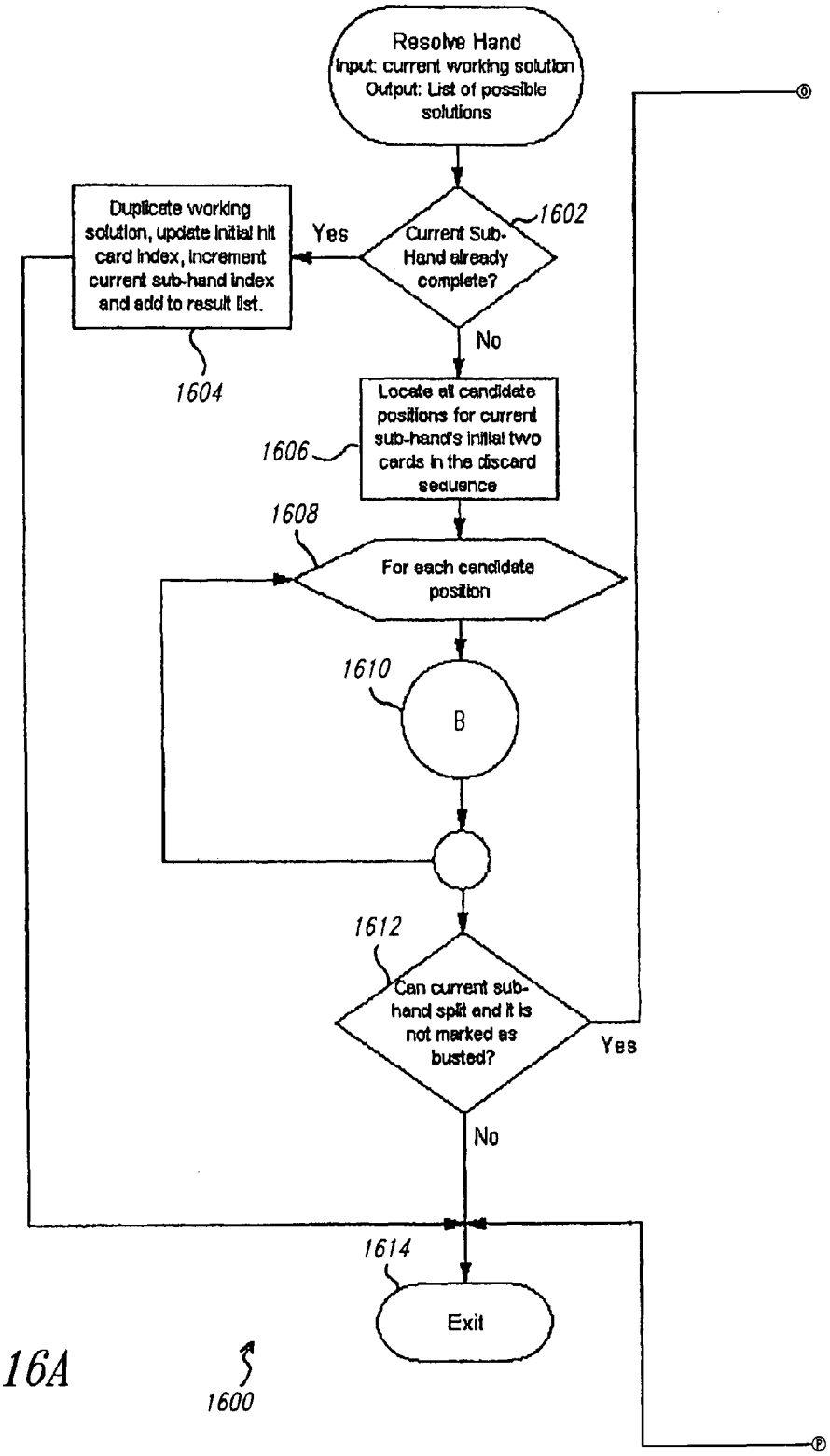
FIGS. 16A-16B show a flowchart of a function that can be used for resolving a hand.
Figure 16B:
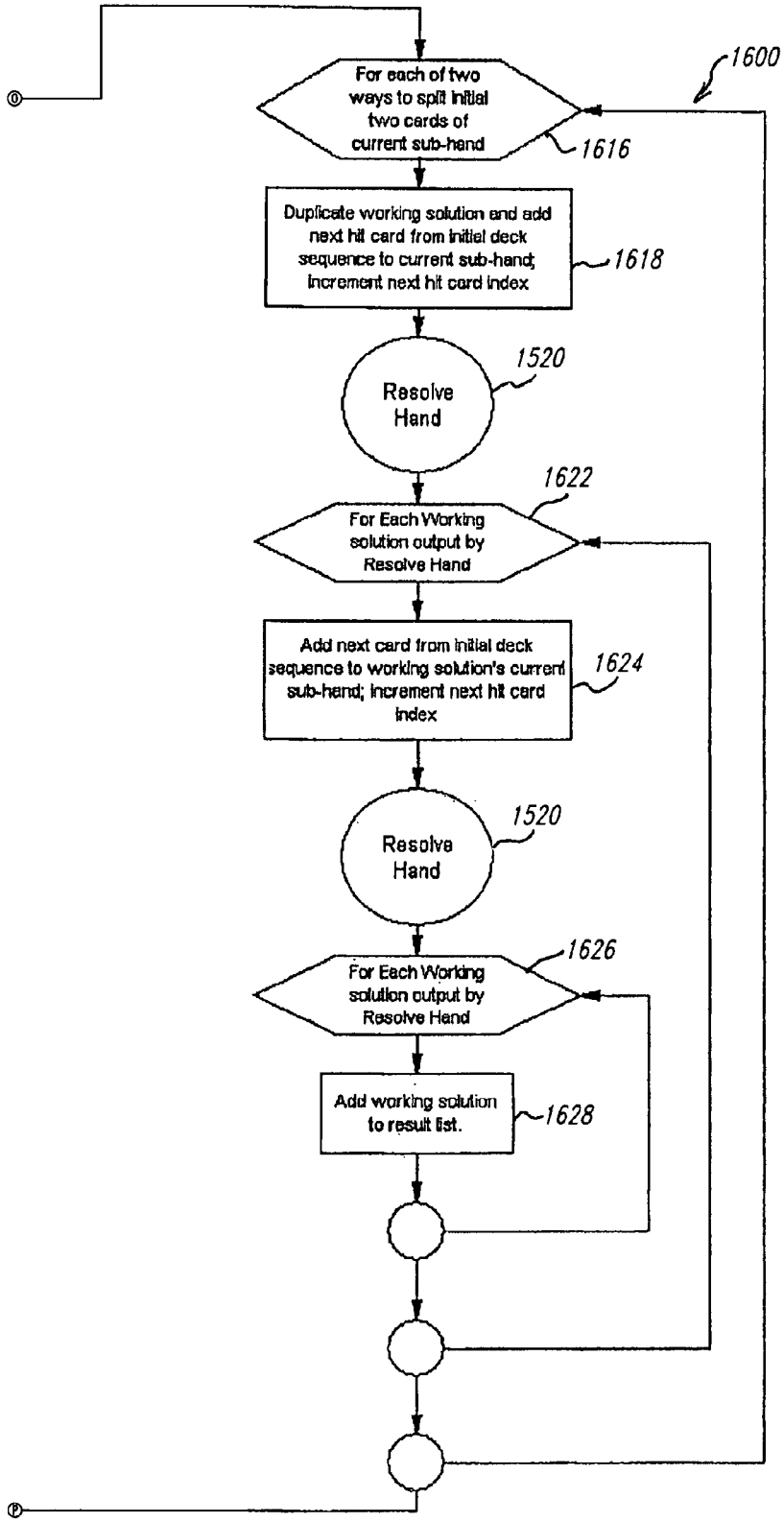

FIGS. 16A-16B (along with FIGS. 17A-17B) is a flowchart 1600 that illustrates an embodiment of a function for resolving a hand at the block 1520 (referred to herein as a "Resolve Hand" function). With this function, an input is the current working solution (a single branch for a single player), and the output is a list of possible working solutions. Thus, additional branches to the decision tree are built.

One sub-hand is processed at a time. If a current sub-hand is already complete at a block 1602, then the working solution is duplicated, the initial hit card index is updated, the current sub-hand index is incremented (since this sub-hand is complete and now the analysis needs to move to the next sub-hand), and the current solution is added to the result list at a block 1604. If the current sub-hand is not complete at the block 1602, then the card game evaluation system 10 locates all candidate positions for the current sub-hand's initial two cards in the discard sequence (from the discard reader 60). For each candidate position in the discard sequence, a subroutine B is performed at a block 1610 to obtain possible working solutions.

Figure 17A:
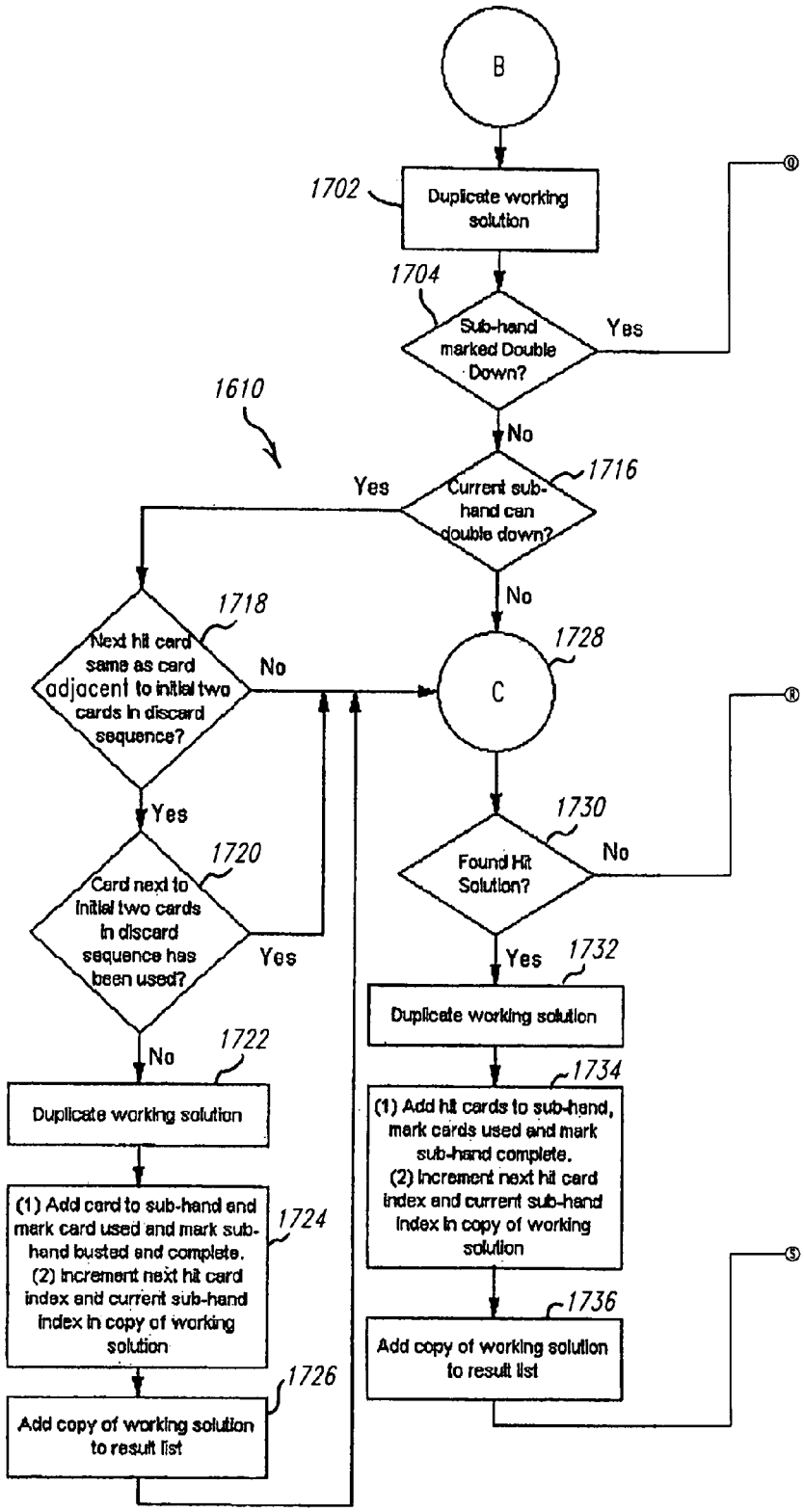
FIGS. 17A-17B show an embodiment of a subroutine for the function of FIGS. 16A-16B.
Figure 17B:
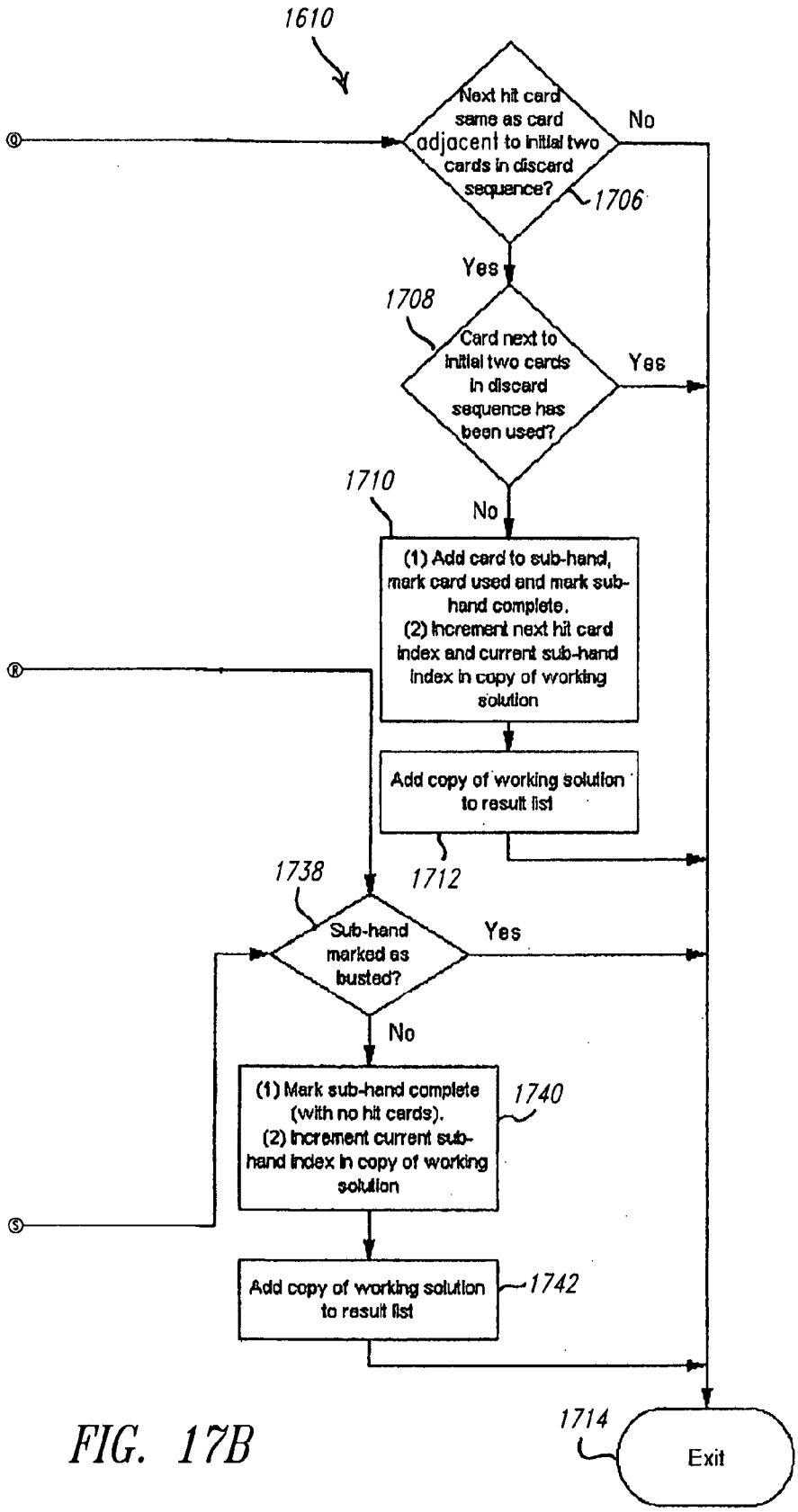

An embodiment of the subroutine B from the block 1610 is illustrated in FIGS. 17A-17B. The current working solution is duplicated at a block 1702. If the current sub-hand is marked double down at a block 1704, then a block 1706 determines if the next hit card is the same as a card adjacent to the initial two hit cards in the discard sequence. If not, then the subroutine B exits back to the Resolve Hand function of FIG. 16A at a block 1714.

If the condition at the block 1706 is met, then a block 1708 determines whether the card next to the initial two cards in the discard sequence has been used. If used, then the subroutine B exits at the block 1714. Else, the card next to the initial two cards in the discard sequence is added to the sub-hand and marked as used, and the sub-hand is marked as complete at a block 1710. Also, the next hit card index and the current sub-hand index are incremented in the copy of the working solution. The copy of the working solution is added to the result list in a block 1712.

Back at the block 1704, if the sub-hand is not marked double down, then a block 1716 determines whether the current sub-hand can double down. If yes, then a block 1718 determines whether the next hit card is the same as the card adjacent to the initial two cards in the discard sequence. If the card is the same, then a block 1720 determines whether the card next to the initial two cards in the discard sequence has been used (i.e., whether the card has been previously accounted for in the solution—if previously accounted for, then there is something that is not right). If not used, then the working solution is duplicated at a block 1722. At a block 1724, the card is added to the sub-hand and marked as used, and the sub-hand is marked busted and complete. Also, the next hit card index and current sub-hand index are incremented in the copy of the working solution. The copy of the working solution is added to the result list at a block 1726.

The subroutine B then proceeds to a subroutine C at a block 1728. The subroutine C is also entered if the conditions at the blocks 1716 and 1718 are not met, and if the condition at the block 1720 is met. An embodiment of the subroutine C is shown in FIG. 18.

Figure 18:
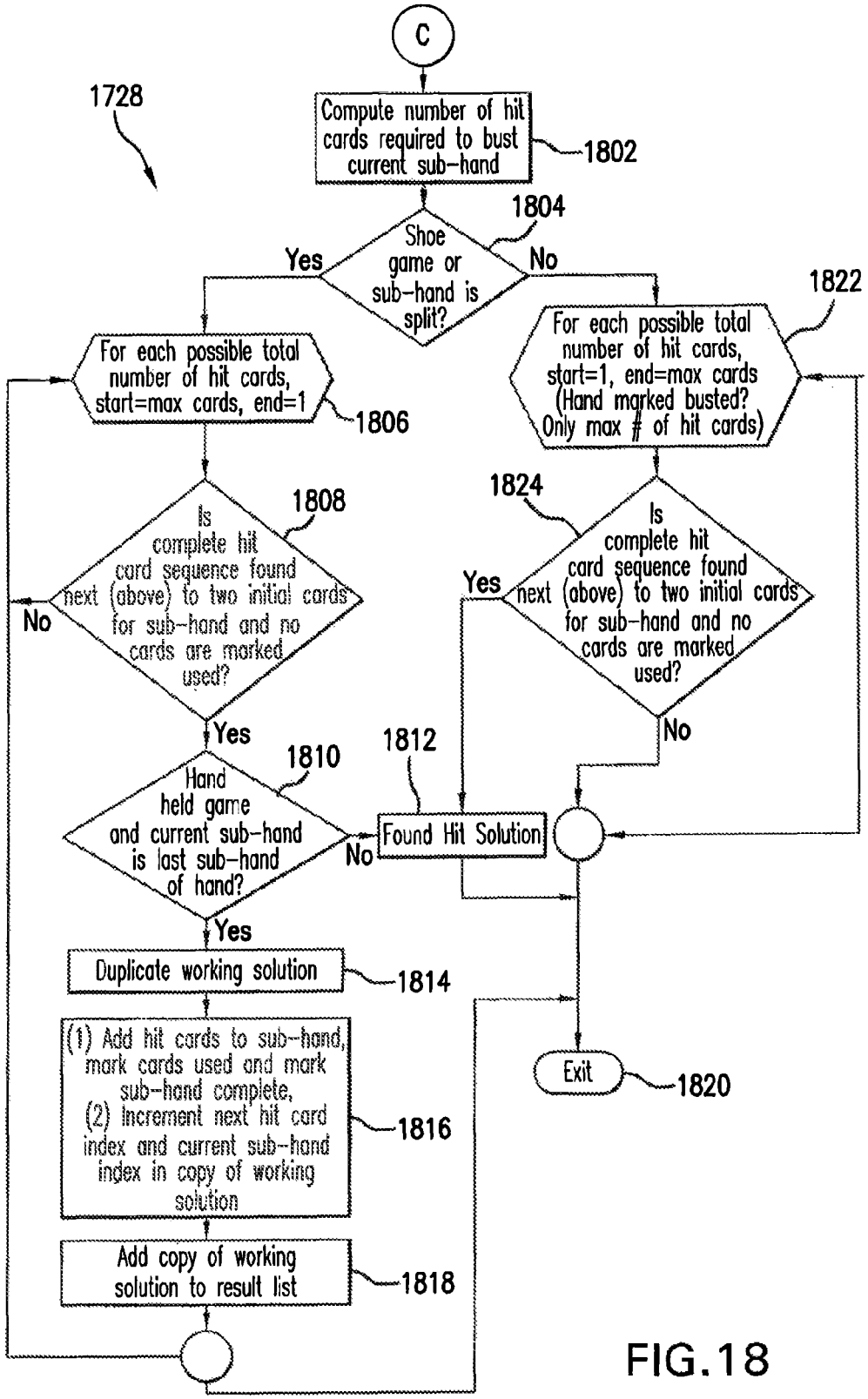
FIG. 18 shows an embodiment of a subroutine for the subroutine of FIGS. 17A-17B.

In FIG. 18, the number of hit cards required to bust the current sub-hand is computed at a block 1802. If the game is a shoe game or if the sub-hand is split, as determined at a block 1804, then an iterative process is performed at a block 1806 for each possible total number of hit cards.

At a block 1808, the card game evaluation system 10 determines whether the complete hit card sequence is found next to (above) the two initial cards for the sub-hand and no cards are marked used. If this condition is not met, then the process reverts back to the block 1806 to analyze the next possible total number of hit cards. If the condition is met and the game type is determined to be a hand-held game, a determination is made at a block 1810 whether the current sub-hand is the last sub-hand of the hand.

If the current sub-hand is the last sub-hand, then the working solution is duplicated at a block 1814. At a block 1816, the hit cards are added to the sub-hand and marked as used, and the sub-hand is marked as complete. Also, the next hit card index and the current-sub hand index in the copy of the working solution are incremented. The copy of the working solution is added to the result list at a block 1818, and the process repeats at the block 1806.

Back at the block 1810, if the condition therein is not met, then the hit solution is found at a block 1812. The subroutine C then exits back to the subroutine B of FIG. 17A at a block 1820.

Back at the block 1804, if the game is hand-held or is not split, an iterative process is performed at a block 1822 for each possible total number of hit cards, wherein a block 1824 determines whether a complete hit card sequence is found next to (above) the two initial hit cards for the sub-hand and no cards are marked used. If these conditions are not met, then the process is repeated for the next possible total number of hit cards at the block 1822. Otherwise, the hit solution is found at the block 1812, and the subroutine C exits at the block 1820 back to the subroutine B of FIG. 17A.

In FIG. 17A, a block 1730 determines whether a hit solution was found by the subroutine C. If a hit solution was found, then the working solution is duplicated at a block 1732. At a block 1734, the hit cards are added to the sub-hand and are marked as used, and the sub-hand is marked as complete. Also, the next hit card index and current sub-hand index are incremented in the copy of the working solution. The copy of the working solution is added to the result list at a block 1736.

At a block 1738, the card game evaluation system 10 determines whether the sub-hand is marked as busted. If not marked as such, the sub-hand is marked complete with no hit cards, and the current sub-hand index in the copy of the working solution is incremented at a block 1740. The copy of the working solution is added to the result list at a block 1742, and the subroutine B exits at a block 1714 back to the Resolve Hand function of FIG. 16A.

Back in FIG. 16A, a block 1612 determines whether the current sub-hand can be split and whether the sub-hand is not marked as busted. If this condition is not met, then the function exits at a block back to the flowchart 1500 of FIGS. 15A-15C. Otherwise, an iteration is performed at a block 1616 for each of two ways to split the initial two cards of the current sub-hand.

At a block 1618, the working solution is duplicated. The next hit card from the initial deck sequence is added to the current sub-hand, and the next hit card index is incremented. The Resolve Hand function is then called internally again at the block 1520 to resolve the sub-hand, and outputs a plurality of working solutions.

At a block 1622, an iterative process is performed for each working solution that is output by the Resolve Hand function. The next card from the initial deck sequence is added to the working solution for the current sub-hand, and the next hit card index is incremented at a block 1624.

The Resolve Hand function is internally called again at the block 1520 to resolve each second sub-hand. An iteration is performed at a block 1626 for each working solution output by the Resolve Hand function, wherein working solutions are added to the result list at a block 1628. When the iterations are complete, the Resolve Hand function exits at the block 1614, having a plurality of solutions in the result list.

Back to the flowchart 1500 of FIG. 15A-15C, an iteration at a block 1522 is performed for each of the working solutions in the result list that is output by the Resolve Hand function. The current player index is incremented in the working solution at a block 1524.

The current player index is compared to the next checkpoint. If the current player index is past the start of the next checkpoint at a block 1526, then the technique of FIG. 19 is used at a block 1528 to determine the validity of the solution.

Referring back now to FIG. 19, the current player is not the dealer at the block 1902. Therefore at the block 1904, the number of hit cards dealt thus far in this solution is counted. The next known first hit card index for a subsequent hand is located at the block 1906. If the number of hit cards dealt thus far does not match the next known hit card index at the block 1908, then the working solution is invalid at the block 1912. Else, the working solution is valid at the block 1910, and the validation process exits back to the flowchart 1500 of FIG. 15A-15C. An invalid solution is discarded at a block 1530, while a valid solution is added to the checkpoint solution list at a block 1532.

Figure 19:
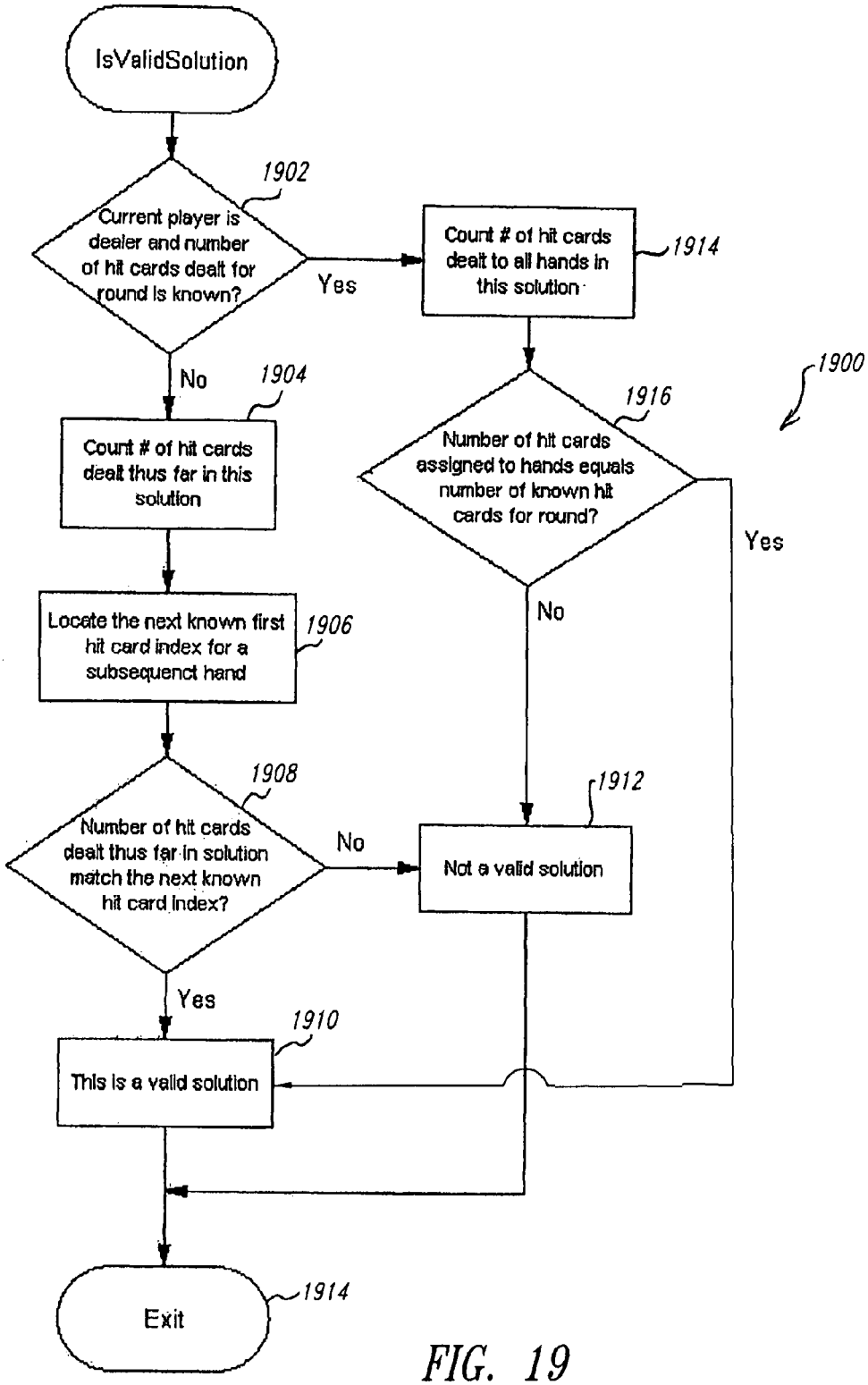
FIG. 19 shows an embodiment of a technique to determine validity of a solution.

If the current player index is not past the start of the next checkpoint at the block 1526, then the validation technique of FIG. 19 is called at a block 1534 to validate the current working solution. The process then repeats afterward to discard an invalid solution at a block 1538 or to add a valid solution to this checkpoint's solution tree.

The iteration repeats for the other solutions output by the Resolve Hand function. Other iterations are then performed for each working solution in a checkpoint's tree.

At a block 1540, confusions or other inconsistent results are eliminated from the checkpoint solution list. That is, an input to this function is a list of working solutions, and the function eliminates solutions that are not consistent with the data that was gathered while the round was tracked. Examples of confusion elimination at the block 1540 include, but are not limited to, the following:

1. If a given hand is reported as double down in one or more working solutions and not reported as double down in one or more working solutions, eliminate solutions where the hand was reported as having doubled down and an extra double down wager was not seen for that that position and eliminate solutions where the hand was not reported as having doubled down and an extra double down wager was seen for that position.
2. For each hand that does not have the same solution in all potential working solutions for the round, eliminate working solutions for which the hand has not taken a hit card on 11 or less, or has hit on hard valued at hard 17 or greater.
3. Eliminate working solutions where the dealer's hit cards were found in the discard rack 60 before the dealer played his hand (i.e., removed their initial two cards from the dealer card reader.)
4. Eliminate working solutions where the player's cards were in the discard rack prior to the playing of the dealer hand (i.e., dealer's initial cards removed from the dealer card hand reader 15) and the player's hand is not reported as busted, surrendered, Blackjack, taken even money or busted split (i.e., if the hand outcome was known prior to the playing of the dealer's hand, the cards should have been in the discard rack 60)
5. Eliminate working solutions where next hit card from the initial deck sequence, as reported by the working solution, cannot be found in the discard rack 60 (i.e., if the working solution indicates that the card has not been played yet, then why then can it be found in the discard rack 60?)
6. If the number of hit cards dealt for the round not yet known, eliminate working solutions if the number of hit cards dealt in the solution is less than the solution with the maximum number of hit cards dealt.
7. Eliminate working solutions where the one of the player's initial two cards cannot be found in the discard rack 60 prior to the dealer playing their hand (i.e., removed their initial two cards from the dealer card hand reader 15) if the player's hand has reported as busting.

Common solutions are found in the checkpoint solution list at a block 1542. At a block 1544, the RoundData object is updated to store the common hand solutions and the initial deck start indices from the checkpoint common solutions. The solutions in the checkpoint solution list are discarded at a block 1546, so as to clear the checkpoint solution list to store solutions for the next checkpoint in the iterative loop.

At a block 1548, a list of final solutions is obtained, and confusions are eliminated therefrom. If the number of resulting final solutions at a block 1550 is equal to 1, then the RoundData object is updated at a block 1552 to set the number of hit cards dealt in the round from the working solution, and the result for the round is copied from the working solution.

If the number of final solutions is greater than 1 at the block 1550, then the common solutions are found in the final solution list at a block 1554. The RoundData object is updated at a block 1556 to store common hand solutions and the initial deck start indices from the final common solutions. The Parse Round function exits at a block 1558, and returns to the flowchart 1000 of FIG. 10 and resumes at the block 1022 until data indicative of the outcome of the round is output at the block 1024.

CONCLUSION

Although specific embodiments and examples are described herein for illustrative purposes, various equivalent modifications can be made without departing from the spirit and scope of the invention, as will be recognized by those skilled in the relevant art. The teachings provided herein can be applied to other systems for evaluating card games, not necessarily the blackjack card evaluation system 10 generally described above. For example, the teachings can employ other networks, such as the World Wide Web portion of the Internet. The various embodiments described above can be combined to provide further embodiments. For example, the illustrated methods can be combined, or performed successively. The illustrated methods can omit some acts, can add other acts, and can execute the acts in a different order than that illustrated to achieve advantages. The teachings of the applications and patents referred to herein are incorporated by reference in their entirety.

These and other changes can be made in light of the above detailed description. In general, in the following claims, the terms used should not be construed to limit the invention to the specific embodiments disclosed in the specification, but should be construed to include all computers, networks and card reading and card evaluation systems that operate in accordance with the claims. Accordingly, the invention is not limited by the disclosure including what is disclosed in the Abstract, but instead its scope is to be determined entirely by the following claims.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

What is claimed is:

1. A method of operating a card game evaluation system for evaluating card games, the method comprising:

for each round of a card game having a plurality of players:

automatically determining a sequence of a set of playing cards in a deck of playing cards by a processor of the card game evaluation system, prior to dealing any of the playing cards from the deck;

for each player, generating a plurality of working solutions representing possible valid and invalid outcomes of each of the player's hands by the processor of the card game evaluation system, based at least in part on the determined sequence of the set of playing cards; and for each player, reducing the plurality of working solutions to a final solution representing a valid outcome of each of the player's hands by the processor of the card game evaluation system, based at least in part on identities of playing cards that have been discarded during the card game, wherein validity of each respective working solution is determined by the processor of the card game evaluation system using a comparison between a number of hit cards dealt in each respective working solution and a subsequent player's next hit card.

2. The method of claim 1 wherein the card game comprises a blackjack game.

3. The method of claim 1, further comprising:

determining a number of players in the card game by the processor of the card game evaluation system;

determining an identity of each of a number of playing cards forming the players' initial hands by the processor of the card game evaluation system, using information from the sequence of playing cards and based on the determined number of players; and determining an identity of an initial hit card dealt to at least one of the players subsequent to that player's initial hand by the processor of the card game evaluation system.

4. The method of claim 3 wherein generating the plurality of working solutions includes:

identifying all player hands in which the identity of the initial hit card dealt subsequent to the initial hand has been determined by the processor of the card game evaluation system;

for each of such identified player hands, locating a plurality of candidate positions of the playing cards of the initial hand among a sequence of playing cards that have been discarded during the card game by the processor of the card game evaluation system;

for each of the candidate positions, determining whether a next hit card is same as a playing card adjacent to playing cards discarded from the initial hand by the processor of the card game evaluation system, and generating a working solution if the same;

computing a possible number of hit cards required to bust a current player hand by the processor of the card game evaluation system; and for each possible number, determining if a complete hit card sequence is found next to playing cards discarded from the initial hand by the processor of the card game evaluation system and obtaining a working solution if the complete hit card sequence is found.

5. The method of claim 4 wherein each of the cards in the deck corresponds to an index respectively 0 to m−1, wherein m is a total number of cards in the deck, wherein reducing the plurality of working solutions in which validity of each respective working solution is determined by the processor of the card game evaluation system using the comparison between the number of hit cards dealt in each respective working solution and the subsequent player's next hit card includes:

counting a number of hit cards dealt in a working solution by the processor of the card game evaluation system;

locating a next known first hit card for a subsequent player's hand by the processor of card game evaluation system;

validating the working solution by the processor of the card game evaluation system if the counted number of hit cards matches an index of the next known hit card for the subsequent player's hand; and otherwise invalidating the working solution by the processor of the card game evaluation system.

6. The method of claim 4 wherein the reducing the plurality of working solutions in which validity of each respective working solution is determined by the processor of the card game evaluation system using the comparison between the number of hit cards dealt in each respective working solution and the subsequent player's next hit card further includes:

determining that a current working solution corresponds to a dealer by the processor of the card game evaluation system;

counting a number of hit cards assigned to all player hands in this current working solution by the processor of the card game evaluation system;

validating the current working solution if the counted number of hit cards assigned to all player hands equals a number of known hit cards for a round of the card game by the processor of the card game evaluation system; and otherwise invalidating the current working solution by the processor of the card game evaluation system.

7. The method of claim 1, further comprising checking pre-dealer hands by the processor of the card game evaluation system to determine possible outcomes of some player hands prior to a dealer playing a dealer hand.

8. The method of claim 7, further comprising:

resolving player hands that have busted outcomes to determine a number of hit cards to bust the player hand by the processor of the card game evaluation system; and inferring to automatically complete the player hands that have busted outcomes, based on information obtained by resolving the player hands by the processor of the card game evaluation system.

9. The method of claim 1, further comprising determining, by the processor of the card game evaluation system, a number of players in the card game by either or both:

determining the number of players based on a number of playing cards in the sequence that are between the playing cards forming a dealer's initial hand by the processor of card game evaluation system; and determining the number of players by detecting a number of bets at a start of the card game by the processor of the card game evaluation system.

10. A method of operating a card game evaluation system for evaluating card games, the method comprising:

for each round of a card game:

determining a number of players in the card game and initial cards dealt to each player to form respective player hands for said players by a processor of the card game evaluation system;

gathering information relating to a timing of events in the card game by the processor of the card game evaluation system, using information associated with rules of the card game and with the determined initial cards, to possibly complete some player hands;

generating a decision tree having a plurality of possible valid and invalid outcomes of each player hand by the processor of the card game evaluation system, the processor of the card game evaluation system using information derived from an initial sequence of cards in the card game to generate the possible outcomes in the decision tree;

comparing identities of discarded cards with the possible outcomes in the decision tree by the processor of the card game evaluation system; and removing as invalid any possible outcome from said decision tree that is inconsistent with said discarded cards by the processor of the card game evaluation system and validating an outcome of a player's hand by the processor of the card game evaluation system if the discarded cards corroborate the outcome, wherein validity of each respective possible outcome is determined by the processor of the card game evaluation system using a comparison between a number of hit cards dealt in each respective possible outcome and a subsequent player's next hit card.

11. The method of claim 10 wherein each of the cards corresponds to an index respectively 0 to m−1, wherein m is a total number of cards, wherein validity of each respective possible outcome is determined by the processor of the card game evaluation system using the comparison between the number of hit cards dealt in each respective possible outcome and the subsequent player's next hit card includes:

identifying an initial hit card for at least one of the player hands by the processor of the card game evaluation system;

counting a number of hit cards dealt to a prior player hand by the processor of the card game evaluation system; and validating an outcome of the at least one player hand by the processor of the card game evaluation system if the counted number of hit cards dealt to the prior player hand matches an index of the identified initial hit card, and otherwise invalidating the outcome by the processor of card game evaluation system.

12. The method of claim 10 wherein generating the decision tree by the processor of card game evaluation system includes iteratively identifying working solutions and generating additional working solutions therefrom by the processor of the card game evaluation system, and wherein validating the outcome of the player hand by the processor of card game evaluation system includes iteratively validating each identified working solution and generated additional working solution.

13. A method of operating a card game evaluation system for evaluating card games, the method comprising:

for each round of a card game having cards indexed respectively 0 to m−1, wherein m is a total number of the cards:

based on determined information, generating a decision tree by a processor of the card game evaluation system having a plurality of branches, each branch of the decision tree corresponding to a respective one of a plurality of possible valid and invalid outcomes of a player hand of the card game; and using information derived from playing cards discarded during the card game and based on possible outcomes of a subsequent player hand, reducing the decision tree by the processor of the card game evaluation system to a set of branches, each branch in the set having a valid outcome of a player hand that is previous to the subsequent player hand, wherein validity of each respective possible outcome is determined by the processor of the card game evaluation system if a number of hit cards dealt in each respective possible outcome matches an index of a next hit card from the subsequent player hand.

14. The method of claim 13 wherein reducing the decision tree by the processor of the card game evaluation system includes eliminating invalid outcomes from the decision tree according to rules of the card game and based on at least some of the determined information.

15. The method of claim 13 wherein the determined information includes at least one of a number of players in the card game, an initial sequence of a deck of cards in the card game, and identities of cards in each player's initial hand.

16. A method of operating a card game evaluation system for evaluating card games, the method comprising:

for each round of a card game having a plurality of players:

automatically determining a sequence of a set of playing cards in a deck of playing cards, prior to a dealer dealing any of the playing cards from the deck in the card game by a processor of card game evaluation system;

automatically determining an identity of each of a number of playing cards forming the dealer's initial hand by the processor of the card game evaluation system;

determining a number of players in the card game in addition to the dealer by the processor of the card game evaluation system;

determining an identity of each of a number of playing cards forming each player's initial hand using the automatically determined sequence of the set of playing cards by the processor of the card game evaluation system;

for each player's hand, generating a plurality of working solutions by the processor of the card game evaluation system each representing possible valid and invalid outcomes of the player's hand; and for each player's hand, reducing the plurality of working solutions by the processor of card game evaluation system to a final solution representing a valid outcome of the player's hand, based at least in part on identities of cards that have been discarded during the card game, wherein validity of each respective working solution is determined by the processor of the card game evaluation system using a comparison between a number of hit cards dealt in each respective working solution and a subsequent player's next hit card.

17. The method of claim 16 wherein generating the plurality of working solutions by the processor of card game evaluation system includes generating the plurality of working solutions based at least in part on determined initial hit cards and rules of the card game.

18. The method of claim 16 wherein each of the cards in the deck corresponds to an index respectively 0 to m−1, wherein m is a total number of cards in the deck, wherein reducing the plurality of working solutions by the processor of the card game evaluation system in which validity of each respective working solution is determined by the processor of the card game evaluation system using the comparison between the number of hit cards dealt in each respective working solution and the subsequent player's next hit card, includes:

eliminating, as invalid by the processor of the card game evaluation system, working solutions for a particular player hand if a number of hit cards dealt in the working solutions for that particular player hand does not match an index of the next hit card of a player hand subsequent to the particular player hand.

19. The method of claim 16 wherein the card came comprises blackjack, and wherein generating the plurality of working solutions by the processor of the card game evaluation system includes generating solutions in accordance with splits and double downs that may possibly occur during the card game.

20. An article of manufacture, comprising:

a computer-readable medium having instructions stored thereon that are executable by a processor to evaluate each round of a card game having a plurality of players, by:

automatically determining a sequence of a set of playing cards in a deck of playing cards, prior to dealing any of the playing cards from the deck;

for each player, generating a plurality of working solutions representing possible valid and invalid outcomes of each of the player's hands, based at least in part on the determined sequence of the set of playing cards; and for each player, reducing the plurality of working solutions to a final solution representing a valid outcome of each of the player's hands, based at least in part on identities of playing cards that have been discarded during the card game, wherein validity of each respective working solution is determined using a comparison between a number of hit cards dealt in each respective working solution and a subsequent player's next hit card.

21. The article of manufacture of claim 20 wherein the computer-readable medium further includes instructions stored thereon that are executable by the processor to evaluate the card game, by:

determining a number of players in the card game;

determining an identity of each of a number of playing cards forming the players' initial hands using information from the sequence of playing cards and based on the determined number of players; and determining an identity of an initial hit card dealt to at least one of the players subsequent to that player's initial hand.

22. The article of manufacture of claim 21 wherein the instructions for generating the plurality of working solutions include instructions executable by the processor to evaluate the card game, by:

identifying all player hands in which the identity of the initial hit card dealt subsequent to the initial hand has been determined;

for each of such identified player hands, locating a plurality of candidate positions of the playing cards of the initial hand among a sequence of playing cards that have been discarded during the card game;

for each of the candidate positions, determining whether a next hit card is same as a playing card adjacent to playing cards discarded from the initial hand, and generating a working solution if the same;

computing a possible number of hit cards required to bust a current player hand; and for each possible number, determining if a complete hit card sequence is found next to playing cards discarded from the initial hand and obtaining a working solution if the complete hit card sequence is found.

23. The article of manufacture of claim 22 wherein each of the cards in the deck corresponds to an index respectively 0 to m, wherein m−1 is a total number of cards in the deck, wherein the instructions executable by the processor to evaluate the card game by reducing the plurality of working solutions in which validity of each respective working solution is determined using the comparison between the number of hit cards dealt in each respective working solution and a subsequent player's next hit card, includes instructions executable by the processor to evaluate the card game by:

counting a number of hit cards dealt in a working solution;

locating a next known first hit card for a subsequent player's hand;

validating the working solution if the counted number of hit cards matches an index of the next known hit card for the subsequent player's hand; and invalidating the working solution otherwise.

24. A system, comprising:

discard card reader means for reading discarded cards from a card game in which cards are indexed respectively 0 to m, wherein m−1 is a total number of the cards; and means for generating, for each round of the card game and based on determined information, a decision tree having a plurality of branches, each branch of the decision tree corresponding to a respective one of a plurality of possible valid and invalid outcomes of a player hand of the card game, and for reducing for each round of the card game the decision tree to a set of branches, each branch in the set having a valid outcome of a player hand that is previous to a subsequent player hand, by using information derived from playing cards discarded during the card game into the discard card reader means and based on possible outcomes of the subsequent player hand, wherein validity of each respective possible outcome is determined if a number of hit cards dealt in each respective possible outcome matches an index of a next hit card from the subsequent player hand.

25. The system of claim 24 wherein the means for generating and reducing further performs:

checking pre-dealer hands;

resolving busted player hands;

inferring hands; and parsing a round of the card game, including the means for generating and reducing the decision tree.

26. The system of claim 24, further comprising:

card deck reader means for reading an initial deck sequence of the playing cards;

dealer hand reader means for reading a dealer's hand; and means for determining a number of players in the card game.

27. A system, comprising:

a card deck reader to read identifying information from a number of playing cards forming a deck of playing cards;

a dealer hand reader to read identifying information from a number of the playing cards forming a dealer's initial hand;

a discard card reader to read identifying information from a number of the playing cards forming a dealer's complete hand and a player's complete hand; and at least one processor coupled to receive the read identifying information from the card deck reader, the dealer hand reader and the discard card reader and programmed for each round of the card game to process the read identifying information to:

generate a decision tree having a plurality of possible valid and invalid outcomes of each player hand, via use of information derived from an initial sequence of cards read by the card deck reader, to generate the possible outcomes in the decision tree; and compare identities of discarded cards with the possible outcomes in the decision tree; and validate an outcome of a player hand if the discarded cards read by the discard card reader corroborate that outcome, wherein validity of each respective possible outcome is determined using a comparison between a number of hit cards dealt in each respective possible outcome and a subsequent player's next hit card.

28. The system of claim 27 wherein each of the cards in the deck corresponds to an index respectively 0 to m, wherein m−1 is a total number of cards in the deck, and wherein to determine validity of each respective possible outcome using the comparison between the number of hit cards dealt in each respective possible outcome and the subsequent player's next hit card, the processor is also programmed to:

identify an initial hit card for at least one of the player hands;

count a number of hit cards dealt to a prior player hand; and validate an outcome of the at least one player hand if the counted number of hit cards dealt to the prior player hand matches an index of the identified initial hit card, and invalidating the outcome otherwise.

29. The system of claim 27 wherein to generate the decision tree, the processor is programmed to iteratively identify working solutions and generate additional working solutions therefrom, and wherein to validate the outcome of the player hand, the processor is programmed to iteratively validate each identified working solution and generated additional working solution.

30. The system of claim 29 wherein the processor is also programmed to eliminate inconsistent results from the working solution.

* * * * *